US009199815B2

(12) United States Patent
Katsura et al.

(10) Patent No.: US 9,199,815 B2
(45) Date of Patent: Dec. 1, 2015

(54) PAPER CONVEYING DEVICE, IMAGE FORMING APPARATUS PROVIDED WITH THE DEVICE AND PAPER CONVEYING METHOD

(71) Applicant: SHARP KABUSHIKI KAISHA, Osaka-shi, Osaka (JP)

(72) Inventors: Norichika Katsura, Osaka (JP); Kohji Aoki, Osaka (JP); Yoshiyuki Kobayashi, Osaka (JP); Haruhisa Furumoto, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 0 days.

(21) Appl. No.: 14/386,689

(22) PCT Filed: Mar. 13, 2013

(86) PCT No.: PCT/JP2013/056964

§ 371 (c)(1),
(2) Date: Sep. 19, 2014

(87) PCT Pub. No.: WO2013/141107

PCT Pub. Date: Sep. 26, 2013

(65) Prior Publication Data

US 2015/0076763 A1 Mar. 19, 2015

(30) Foreign Application Priority Data

Mar. 19, 2012 (JP) ..... 2012-061842

(51) Int. Cl.
*B65H 7/20* (2006.01)
*B65H 9/00* (2006.01)
(Continued)

(52) U.S. Cl.
CPC .. *B65H 7/20* (2013.01); *B65H 3/44* (2013.01); *B65H 5/068* (2013.01); *B65H 5/26* (2013.01);
(Continued)

(58) Field of Classification Search
CPC ..... B65H 9/006; B65H 3/06; B65H 5/06; B65H 5/062; B65H 2301/331; B65H 2511/11; B65H 2551/10
USPC ..... 271/242
See application file for complete search history.

(56) References Cited

U.S. PATENT DOCUMENTS 6,181,906 B1 * 1/2001 Shiratori ..... 399/367
8,554,125 B2 * 10/2013 Nukumi ..... 399/394
(Continued)

FOREIGN PATENT DOCUMENTS

| | | |
|---|---|---|
| JP | 10-194529 | 7/1998 |
| JP | 2007-161479 | 6/2007 |
| JP | 2008-114980 | 5/2008 |
| JP | 2009-263046 | 11/2009 |

OTHER PUBLICATIONS

International Search Report for PCT/JP2013/056964, mailed Apr. 16, 2013.

*Primary Examiner* — David H Bollinger
(74) *Attorney, Agent, or Firm* — Nixon & Vanderhye, P.C.

(57) ABSTRACT

A paper conveying device includes: a registration roller pair provided along a paper conveying path; a pick-up roller, a paper feed roller and a separation roller for feeding sheets of paper to the paper conveying path; and a controller controlling conveyance of sheets of paper such that when a preceding sheet is stopped at the registration roller pair, a following, succeeding sheet is temporarily stopped at a prescribed position G downstream of a conveying roller in the paper conveying direction, and the succeeding sheet is re-conveyed toward the registration roller pair at a prescribed timing. The controller changes the timing to start re-conveyance of the succeeding sheet in accordance with paper length of the conveyed sheet of paper.

19 Claims, 18 Drawing Sheets

(51) Int. Cl.

| | |
|---|---|
| ***B65H 7/02*** | (2006.01) |
| ***B65H 3/44*** | (2006.01) |
| ***B65H 5/26*** | (2006.01) |
| ***G03G 15/00*** | (2006.01) |
| ***B65H 5/06*** | (2006.01) |
| ***B65H 7/08*** | (2006.01) |

(52) U.S. Cl.

CPC .. *B65H 7/02* (2013.01); *B65H 7/08* (2013.01); *B65H 9/002* (2013.01); *B65H 9/006* (2013.01); *G03G 15/6564* (2013.01); *B65H 2511/10* (2013.01); *B65H 2511/11* (2013.01); *B65H 2511/20* (2013.01); *B65H 2511/22* (2013.01); *B65H 2513/50* (2013.01); *B65H 2553/61* (2013.01); *B65H 2801/06* (2013.01)

(56) References Cited

U.S. PATENT DOCUMENTS

| | | | | |
|---|---|---|---|---|
| 2008/0106030 | A1 | 5/2008 | Takenaka | |
| 2008/0211173 | A1* | 9/2008 | Takahashi et al. | 271/226 |
| 2008/0224386 | A1* | 9/2008 | Kunieda et al. | 271/226 |
| 2009/0302528 | A1* | 12/2009 | Ubayashi | 271/229 |
| 2009/0309291 | A1* | 12/2009 | Yasui et al. | 271/9.01 |
| 2010/0296856 | A1* | 11/2010 | Moriyama | 400/642 |
| 2011/0291346 | A1* | 12/2011 | Dan | 271/3.16 |
| 2011/0291353 | A1* | 12/2011 | Fujiwara et al. | 271/258.01 |
| 2013/0099441 | A1* | 4/2013 | Kikuchi et al. | 271/10.13 |
| 2013/0134661 | A1* | 5/2013 | Yoshinaga | 271/225 |

* cited by examiner

FIG. 6
FIG. 6A
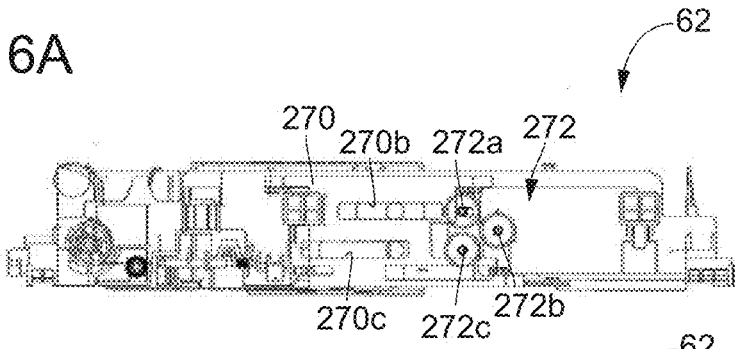
FIG. 6B
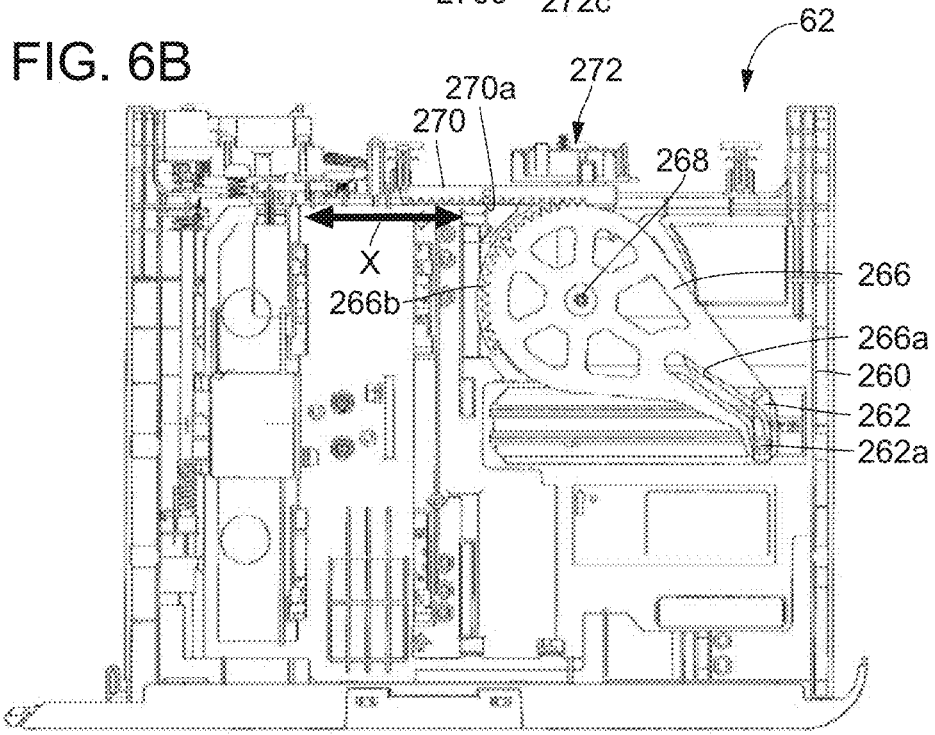

FIG. 7
FIG. 7A
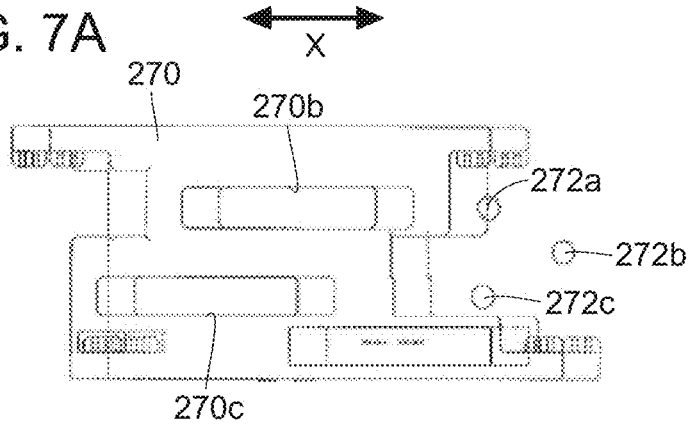
FIG. 7B
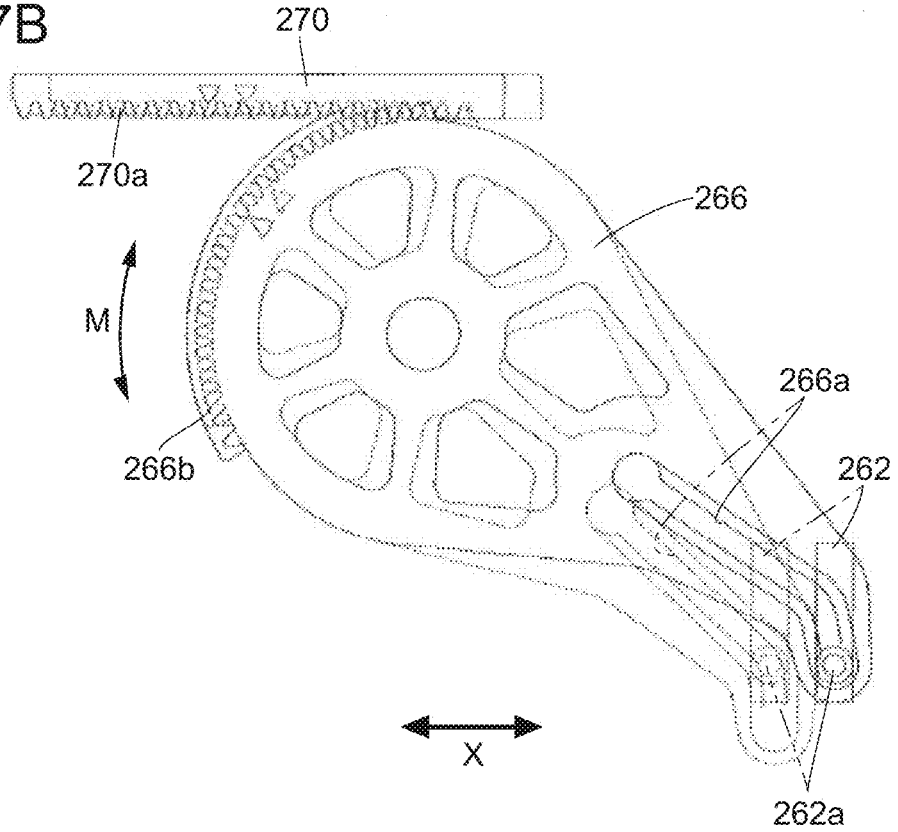

PAPER CONVEYING DEVICE, IMAGE FORMING APPARATUS PROVIDED WITH THE DEVICE AND PAPER CONVEYING METHOD

This application is the U.S. national phase of International Application No. PCT/JP2013/056964, filed 13 Mar. 2013, which designated the U.S. and claims priority to Japan Application No. 2012-061842, filed 19 Mar. 2012, the entire contents of each of which are hereby incorporated by reference.

TECHNICAL FIELD

The present invention relates to a paper conveying device, an image forming apparatus provided with the device, and a method of conveying paper. More specifically, the present invention relates to a paper conveying device capable of successively conveying a plurality of sheets of paper, an image forming apparatus provided with the device and a method of conveying sheets of paper.

BACKGROUND ART

As is well known, an image forming apparatus such as a printer or a copy machine is provided with a paper feed device for feeding sheets of paper one by one. The sheet of paper fed by the paper feed device is conveyed to a paper forming unit, in which image is formed. Between the paper feed device and the image forming unit, a pair of registration rollers is arranged for registering leading edge of the sheet and for skew correction. The conveyed sheet is once stopped at the pair of registration rollers for skew correction, and conveyed again to the image forming unit with timing adjusted for alignment with the image to be formed.

In a high-speed apparatus capable of high-speed printing, there is a demand to increase the number of copies per unit time (CPM: Copy Per Minute) as much as possible while not very much increasing the speed of image formation in copy-printing (process speed) (with the process speed kept as low as possible). In order to meet such a demand, it is desirable to make as narrow as possible the space or interval between a preceding sheet and a following, succeeding sheet, when the sheets are fed successively.

Patent Literature 1, which will be described later, proposes a method of controlling paper feeding and conveyance enabling feeding and conveyance of paper without reducing productivity. According to the method of controlling paper feeding and conveyance of Patent Literature 1, when the leading edge of preceding sheet is stopped at the registration roller pair, the trailing edge of the preceding sheet is detected by a sensor provided along a conveying path, and a trigger that determines the timing to start feeding of the next sheet is changed in accordance with the result of detection. Specifically, that the trailing edge of preceding sheet has passed through the sensor, or that re-conveyance of the preceding sheet after temporarily stop at the registration roller pair has started, is used as the trigger for determining the timing to start feeding of the next sheet, depending on the result of detection.

If the passage of trailing edge of preceding paper through the sensor is used as the trigger and the trailing edge of preceding sheet is stopped held on the paper conveying device while the leading edge of the preceding sheet is stopped at the registration roller pair, it follows that the time of passage through the sensor serving as a trigger to start feeding of the next sheet will be after re-conveyance of the preceding sheet by the registration roller pair. In that case, the interval between the sheets becomes too wide, leading to lower productivity.

Therefore, according to Patent Literature 1, if the sensor detects that the trailing edge of preceding sheet is stopped held on paper conveying device, the trigger to start feeding of the next sheet is changed to the start of re-conveyance of the preceding paper after temporary stop at the registration roller pair. In this manner, the interval between sheets of paper is made narrower, to prevent the paper interval from becoming too long.

CITATION LIST

Patent Literature

PTL 1: Japanese Patent Laying-Open No. 2007-161479

SUMMARY OF INVENTION

Technical Problem

By the technique of Patent Literature 1, however, the interval between the sheets is not sufficiently short and the above-described demand for increasing CPM as much as possible cannot be fully satisfied.

On the other hand, variation in conveyance sometimes occurs when sheets of paper are conveyed in an image forming apparatus. Such variation in conveyance has more significant influence on image formation as the interval between sheets becomes shorter. Therefore, with higher CPM, it becomes more difficult to realize successful printing on the sheets of paper. By way of example, if the interval between sheets is short, variation of conveyance increases the possibility that the succeeding sheet arrives at the registration roller pair before the registration roller pair stops rotation. In such a case, the arriving sheet enters a nip portion of the registration roller pair, making skew correction impossible. Further, since the sheet is fed earlier with respect to the image to be formed, position registration timing is missed and the images are varied in position. Since it has been difficult to increase CPM without sacrificing the print quality as described above, the CPM and the process speed have conventionally been determined within the range that can cope with such variation in conveyance.

The present invention was made to solve such a problem and its object is to provide a paper conveying device capable of conveying sheets of paper without lowering print quality and increasing the number of prints per unit time, an image forming apparatus provided with the device, and a method of conveying sheets of paper.

Solution to Problem

In order to attain the above-described object, according to a first aspect, the present invention provides a paper conveying device, including: paper feeding means for feeding a sheet of paper to a paper conveying path; registration means, provided along the paper conveying path, for temporarily stopping the conveyed sheet of paper and re-conveying the sheet of paper; conveyer means, provided in the paper conveying path from the paper feeding means to the registration means, for conveying the sheet of paper fed to the paper conveying path to the registration means; paper size receiving means for receiving information related to a size of the conveyed sheet of paper; and conveyance control means for controlling conveyance of the sheet of paper such that when a plurality of sheets of paper are fed successively to the paper conveying path and a preceding sheet of paper is stopped at the registration means, a following, succeeding sheet of paper is temporarily stopped at a prescribed position downstream of the conveying means in the paper conveying direction, and then the sheet is re-conveyed toward the registration means at a prescribed timing. The conveyance control means includes re-conveyance start timing changing means for changing a timing to start re-conveyance of the succeeding sheet of paper in accordance with paper length in the paper conveying direction of the conveyed sheet of paper received by the paper size receiving means.

When the preceding sheet of paper is stopped at the registration means, the following, succeeding sheet is temporarily stopped at a prescribed position downstream of the conveying means in the paper conveying direction. Thus, the succeeding sheet is conveyed closer to the preceding sheet and kept in a standby state at that position. Thereafter, the sheet is conveyed again toward the registration means at a prescribed timing. Thus, the interval between the preceding and succeeding sheets can easily be made shorter.

Here, if the succeeding sheet is temporarily stopped, the load of the conveying system on the succeeding sheet may vary depending on the length of the sheet (length in the paper conveying direction). By way of example, if the sheet is long, when the leading edge of the sheet reaches the position of temporary stopping, the succeeding sheet will be held at the paper feeding means. In that case, the load of the conveying system (paper feed system) of the paper feeding means will be exerted on the succeeding sheet and, hence, the load of the conveying system on the succeeding sheet becomes large. The load makes it easier to stop the succeeding sheet at the temporary stopping position. On the other hand, if a sheet is short, when the leading edge of the sheet reaches the temporary stopping position, the succeeding sheet may not be held at the paper feeding means. In that case, the load of the conveying system (paper feed system) of the paper feeding means will not be exerted on the succeeding sheet, and hence, the load of the conveying system on the succeeding sheet becomes smaller. It becomes less easy to stop the succeeding sheet at the temporary stopping position and, therefore, the leading edge of the succeeding sheet will be stopped at a position on the side more downstream than the temporary stopping position, in the paper conveying direction. In this manner, depending on the length of conveyed sheet, the position where it is temporarily stopped deviates. Specifically, in accordance with the length of conveyed sheet, the load of conveying system becomes different, causing deviation in the position where the sheet is stopped. If the timing to start re-conveyance to the registration means is made constant regardless of such positional deviation, conveyance variation results.

Therefore, in the paper conveying device of the present invention, the timing to start re-conveyance of the succeeding sheet is changed, in accordance with the length of the conveyed sheet. Thus, the interval between the sheets at the registration means can be made constant. Consequently, the conveyance variation can be reduced even if CPM is increased. Since the conveyance variation can be reduced, the registration means can temporarily stop the conveyed sheet and re-convey the sheet. Thus, the skew correction of the sheet can be done successfully and the leading edge reference can be aligned by ensuring good timing for positional registration. As a result, degradation of print quality can be prevented. In this manner, the number of prints per unit time (CPM) can be increased as much as possible while not very much increasing the speed of image formation in copy-printing (process speed) (with the process speed kept as low as possible), and the productivity can be improved.

Preferably, the re-conveyance start timing changing means includes means for changing the timing to start re-conveyance of the succeeding sheet of paper based on a path length from the paper feeding means to the position at which the succeeding sheet of paper is temporarily stopped and on the paper length of the conveyed sheet of paper.

Based on the path length from the paper feeding means to the position where the succeeding sheet is temporarily stopped and on the length of conveyed sheet, the timing to start re-conveyance of succeeding sheet is changed, whereby the conveyance variation can easily be reduced.

More preferably, the re-conveyance start timing changing means includes means for determining whether the paper length of the conveyed sheet of paper is shorter than a path length from the paper feeding means to the position at which the succeeding sheet of paper is temporarily stopped, and changing the timing to start re-conveyance of the succeeding sheet of paper depending on the result of determination.

More preferably, when the paper length of the conveyed sheet of paper is determined to be shorter than the path length from the paper feeding means to the position at which the succeeding sheet of paper is temporarily stopped, the means for changing the timing delays the timing to start re-conveyance of the succeeding sheet of paper by a prescribed time period; and when the paper length of the conveyed sheet of paper is determined to be not shorter than the path length from the paper feeding means to the position at which the succeeding sheet of paper is temporarily stopped, the means for changing the timing does not change the timing to start re-conveyance of the succeeding sheet of paper.

Whether the paper length of conveyed sheet is longer than the path length from the paper feeding means to the position where the succeeding sheet is temporarily stopped is determined. When the length of conveyed sheet is determined to be shorter than the path length from the paper feeding means to the position where the succeeding sheet is temporarily stopped, the timing to start re-conveyance of the succeeding sheet is delayed by a prescribed time period. In this manner, the interval between sheets at the registration means can easily be kept constant. When the length of conveyed sheet is determined to be not shorter than the path length from the paper feeding means to the position where the succeeding sheet is temporarily stopped, it means that the succeeding sheet more easily stops at the temporary stopping position and, positional deviation is less likely at the temporary stopping position. In that case, the timing to start re-conveyance of the succeeding sheet is unchanged, and thus, the interval between the sheets at the registration means can easily be kept constant. Thus, by the configuration described above, conveyance variation can more easily be reduced.

More preferably, the paper conveying device further includes paper detection means, arranged close to the conveying means, at a prescribed position upstream of the registration means in the paper conveying direction, for detecting a state of conveyance of the sheet of paper, and the conveyance control means includes means for temporarily stopping the succeeding sheet of paper at the prescribed position downstream of the conveying means in the paper conveying direction, at a timing when the paper detection means detects a leading edge of the sheet.

Since the timing when the leading edge of the sheet is detected by the sheet detecting means is used as the trigger, it becomes easier to temporarily stop the succeeding sheet at the prescribed position downstream of the conveying means in the paper conveying direction. Thus, it becomes easier to keep the succeeding sheet in the standby state closer to the preceding sheet.

More preferably, the paper conveying device further includes paper detection means, arranged close to the conveying means, at a prescribed position upstream of the registration means in the paper conveying direction, for detecting a state of conveyance of the sheet of paper, and the conveyance control means includes means for temporarily stopping the succeeding sheet of paper at the prescribed position downstream of the conveying means in the paper conveying direction, a prescribed time period after the paper detection means detects a leading edge of the sheet.

Since the timing a prescribed time period after the sheet detecting means detects the leading edge of the sheet is used as the trigger, it becomes easier to temporarily stop the succeeding sheet at the prescribed position downstream of the conveying means in the paper conveying direction. Thus, also by this approach, it becomes easier to keep the succeeding sheet in the standby state closer to the preceding sheet.

More preferably, the paper conveying device further includes: paper detection means, arranged close to the conveying means, at a prescribed position upstream of the registration means in the paper conveying direction, for detecting a state of conveyance of the sheet of paper; and a plurality of paper containing means for containing sheets of paper to be fed to the paper conveying path. The conveyance control means temporarily stops any sheet of paper fed from the plurality of paper containing means to the paper conveying path, at the prescribed position downstream of the conveying means in the paper conveying direction, at a timing when the paper detection means detects a leading edge of the sheet.

Any sheet fed from the plurality of paper storage means to the paper conveying path will be temporarily stopped at the same position. Therefore, when the timing to start re-conveyance of succeeding sheet is to be changed in accordance with the length of conveyed sheet, it becomes easier to change the timing to start re-conveyance.

More preferably, the paper conveying device further includes: paper detection means, arranged close to the conveying means, at a prescribed position upstream of the registration means in the paper conveying direction, for detecting a state of conveyance of the sheet of paper; and a plurality of paper containing means for containing sheets of paper to be fed to the paper conveying path. The conveyance control means temporarily stops any sheet of paper fed from the plurality of paper containing means to the paper conveying path, at the prescribed position downstream of the conveying means in the paper conveying direction, a prescribed time period after the paper detection means detects a leading edge of the sheet.

Any sheet fed from the plurality of paper storage means to the paper conveying path will be temporarily stopped at the same position. Therefore, when the timing to start re-conveyance of succeeding sheet is to be changed in accordance with the length of conveyed sheet, it becomes easier to change the timing to start re-conveyance.

More preferably, the paper conveying device further includes deviation amount measuring means for measuring amount of positional deviation generated when the succeeding sheet of paper is temporarily stopped at the prescribed position downstream of the conveying means in the paper conveying direction, and the re-conveyance start timing changing means includes means for changing the timing to start re-conveyance of the succeeding sheet of paper in accordance with the amount of positional deviation measured by the deviation amount measuring means.

Since the timing to start re-conveyance of succeeding sheet is changed in accordance with the amount of deviation measured by the deviation amount measuring means, it becomes easier to keep constant the interval between the sheets at the registration means. Thus, conveyance variation can more easily be reduced.

According to a second aspect, the present invention provides an image forming apparatus including image forming means for forming an image, and the paper conveying device in accordance with the first aspect described above, for conveying sheets of paper to the image forming means. By this configuration, an image forming apparatus capable of increasing the number of copies per unit time (CPM) as much as possible while not very much increasing the speed of image formation in copy-printing (process speed) (with the process speed kept as low as possible) can be provided.

According to a third aspect, the present invention provides a method of conveying paper, including the steps of: receiving information related to a size of a sheet of paper to be conveyed; successively feeding a plurality of sheets of paper by a paper feed unit to a paper conveying path; by a conveying section provided on said paper conveying path; conveying the sheets of paper fed to the paper conveying path to a registration roller pair; temporarily stopping, when a preceding sheet of paper is stopped at the registration roller pair, a following, succeeding sheet of paper at a prescribed position downstream of said conveying section in the paper conveying direction; and re-conveying the temporarily stopped sheet of paper to the registration roller pair at a prescribed timing. The step of re-conveyance includes a step of changing a timing to start re-conveyance in accordance with paper length of the conveyed sheet of paper in the paper conveying direction received at the receiving step.

When the preceding sheet is stopped at the registration roller pair, the following, succeeding sheet is temporarily stopped at a prescribed position downstream of the section in the paper conveying direction. Thus, the succeeding sheet is conveyed closer to the preceding sheet and kept in a standby state at that position. Thereafter, the sheet is conveyed again toward the registration roller pair at a prescribed timing. Thus, the interval between the preceding and succeeding sheets can easily be made narrower.

The timing to start re-conveyance of the succeeding sheet is changed, in accordance with the length of the conveyed sheet. Thus, the interval between the sheets at the registration roller pair can be made constant. Consequently, the conveyance variation can be reduced even if CPM is increased, and degradation of print quality can be prevented. As a result, the number of prints per unit time (CPM) can be increased as much as possible while not very much increasing the speed of image formation in copy-printing (process speed) (with the process speed kept as low as possible), and the productivity can be improved.

Advantageous Effects of Invention

As described above, by the present invention, a paper conveying device capable of conveying sheets of paper without lowering print quality and increasing the number of prints per unit time, an image forming apparatus provided with the device, and a method of conveying sheets of paper can easily be provided.

BRIEF DESCRIPTION OF DRAWINGS

FIG. 6 includes a side view FIG. 6A of the paper feed tray and a plan view FIG. 6B of the paper feed tray viewed from the backside, both showing the configuration of the paper feed tray.

FIG. 7 includes FIG. 7A showing a relation between a paper size detecting member and a sensor unit, and FIG. 7B showing a relation between each of the paper size detecting member, a spur gear body and a paper trailing edge plate, both showing the configuration of the paper feed tray.

DESCRIPTION OF EMBODIMENTS

Figure 1:
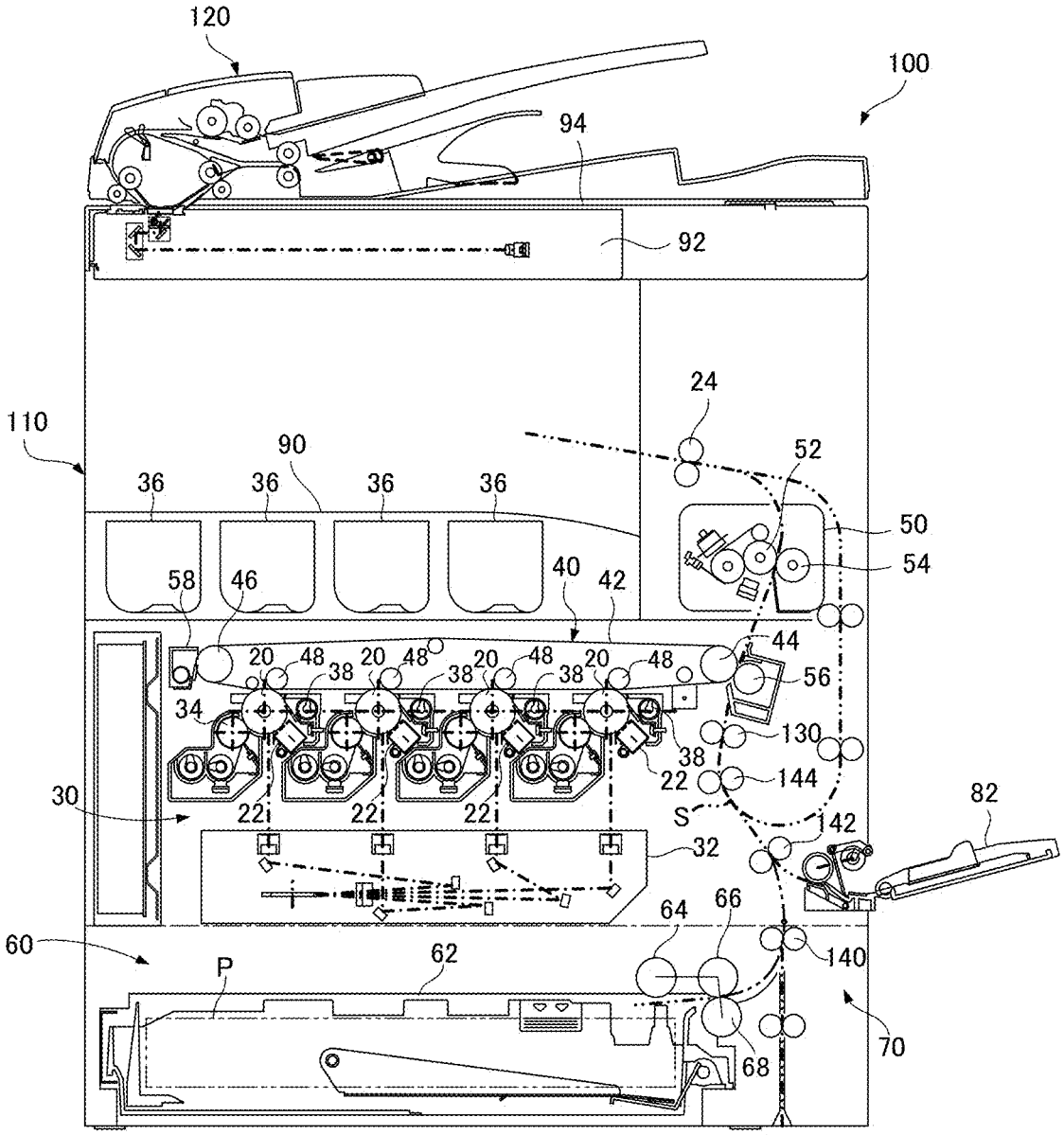
FIG. 1 shows an overall configuration (internal configuration) of the image forming apparatus in accordance with the first embodiment of the present invention.

In the following embodiments, the same components are denoted by the same reference characters. Their functions and names are also the same. Therefore, detailed description thereof will not be repeated. In the following, the image forming apparatus in accordance with the embodiments of the present invention will be described as a tandem-type, full-color apparatus. The apparatus, however, may be of a different type (for example, 4-cycle) full-color or monochrome apparatus.

(First Embodiment)

Referring to FIG. 1, an image forming apparatus 100 in accordance with the present embodiment is an MFP (Multi-Function Peripheral) including copy and printer functions. Image forming apparatus 100 has a so-called laser type (electrophotographic) print function, utilizing a laser beam for exposure. The apparatus, however, may have a different type print function.

[Overall Configuration]

Image forming apparatus 100 forms a multi-color or monochrome image on a prescribed sheet of paper, based on image data read by a scanner, or image data transmitted from an external device such as a client personal computer (hereinafter referred to as a "client PC") 600 shown in FIG. 8. For this purpose, image forming apparatus 100 includes an image forming unit 30 having a photoreceptor drum 20, a transfer mechanism 40 for directly or indirectly transferring a toner image formed on photoreceptor drum 20 to a sheet of paper P, and a fixing unit 50 melting not-yet fixed toner of the toner image that has been transferred to the sheet of paper P and fixing the toner image on the sheet P.

Image forming apparatus 100 further includes a paper feed tray 62 serving as a paper storage unit 60 and capable of storing a plurality of sheets of paper P, and a paper conveying unit 70 conveying sheets of paper P fed from paper feed tray 62 to image forming unit 30.

Image forming apparatus 100 mainly consists of a main body 110 and an automatic document feeder 120. Main body 110 includes image forming unit 30, transfer mechanism 40, fixing unit 50, paper feed tray 62, paper conveying unit 70, a paper discharge tray 90, and a scanner unit 92. Image forming unit 30 includes an exposure unit 32, a developer 34, photoreceptor drum 20, a toner supplying device 36, a cleaner unit 38 and a charger 22.

Image data handled in image forming apparatus 100 is data corresponding to a color image using black (K), cyan (C), magenta (M) and yellow (Y). Therefore, in order to form four different latent images of respective colors, four developers 34, four photoreceptor drums 20, four chargers 22 and four cleaner units 38 are provided, and these components form four image stations for processing black, cyan, magenta and yellow, respectively.

At an upper portion of main body 110, a platen 94 of transparent glass for placing a document is arranged. An automatic document feeder 120 is attached to main body 110 to be opened/closed with respect to platen 94.

Below platen 94, a scanner unit 92 for reading image information of a document is arranged. Below scanner unit 92, exposure unit 32, photoreceptor drum 20, developer 34, toner supplying device 36, charger 22, cleaner unit 38, transfer mechanism 40, fixing unit 50 and paper discharge tray 90 are arranged.

Exposure unit 32 has a function of exposing charged photoreceptor drum 20 in accordance with input image data and thereby forming latent electrostatic image in accordance with the image data on the surface of the drum. Exposure unit 32 is implemented as a laser scanning unit (LSU) including a laser emitting unit and a reflection mirror. In exposure unit 32, optical elements including a polygon mirror for laser beam scanning and a lens and a mirror for guiding a laser beam reflected by the polygon mirror to photoreceptor drum 20 are arranged.

Figure 8:
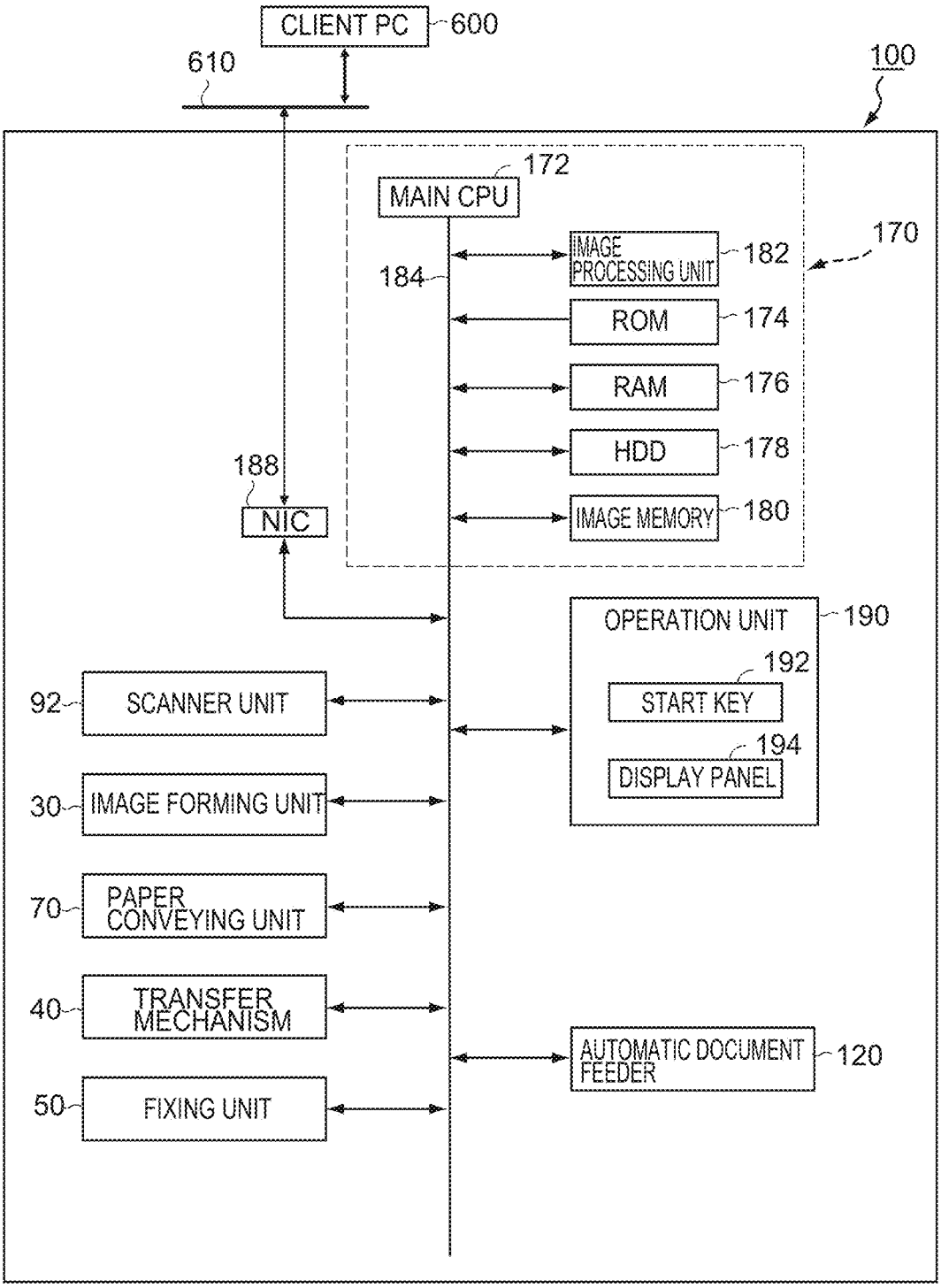
FIG. 8 is a block diagram showing a hardware configuration of the image forming apparatus shown in FIG. 1.

Photoreceptor drum 20 is arranged above exposure unit 32 and rotates in a prescribed direction under the control of driving means, not shown, and a controller 170 shown in FIG. 8. Around photoreceptor drum 20, developer 34, charger 22 as an electric field generator, and cleaner unit 38 are arranged. Developer 34 is for developing the latent electrostatic image formed on each photoreceptor drum 20 by the toner of four colors (C, M, Y, K). Below developer 34, a pair of registration rollers 130 is arranged on the upstream side in the paper conveying direction. Toner supplying device 36 is arranged above developer 34, and it supplies toner discharged from a toner container (not shown) filled with toner to developer 34. Charger 22 is arranged close to an outer circumferential surface of photoreceptor drum 20, to uniformly charge the surface of photoreceptor drum 20 to a prescribed potential. Cleaner unit 38 removes and recovers toner left on the surface of photoreceptor drum 20 after development and image formation.

Transfer mechanism 40 includes an intermediate transfer belt 42, an intermediate transfer belt driving roller 44, an intermediate transfer belt driven roller 46, an intermediate transfer roller 48 and an intermediate transfer belt cleaning unit 58. There are four intermediate transfer rollers 48, corresponding to respective colors of C, M. Y and K. Around intermediate transfer belt driving roller 44, intermediate transfer belt driven roller 46 and intermediate transfer roller 48, intermediate transfer belt 42 is wound and driven to rotate. Each intermediate transfer roller 48 supplies transfer bias for transferring the toner image on the corresponding photoreceptor drum 20 to intermediate transfer belt 42.

Intermediate transfer belt 42 is provided to be in contact with the four photoreceptor drums 20. By successively transferring the toner images of respective colors formed on photoreceptor drums 20 superposed on intermediate transfer belt 42, image forming apparatus 100 forms a color toner image (multi-color toner image) on intermediate transfer belt 42. Intermediate transfer belt 42 is formed as an endless belt, using a film having the thickness of about 100 μm to 150 μm.

Transfer of the toner image from photoreceptor drum 20 to intermediate transfer belt 42 is done by intermediate transfer roller 48 that is in contact with the back side of intermediate transfer belt 42. A high voltage transfer bias (high voltage of a polarity (+) opposite to the charged polarity (−) of the toner) is applied to intermediate transfer roller 48, in order to transfer the toner image. Intermediate transfer roller 48 has a metal shaft (for example, of stainless steel) of 8 to 10 mm in diameter as a base, with its surface covered by a conductive elastic member (such as ethylene propylene diene rubber or urethane foam). Because of this conductive elastic member, uniform high voltage can be applied to intermediate transfer belt 42. Though a roller-shaped transfer electrode is used in the present embodiment, a brush or the like may be used as an alternative.

The electrostatic images turned to visual images in accordance with the hue on respective photoreceptor drums 20 as described above are superposed or stacked on intermediate transfer belt 42. Information of the thus superposed images is transferred to a sheet of paper P, as intermediate transfer belt 42 is rotated, by a transfer roller 56 arranged at the position of contact between the intermediate transfer belt 42 and the sheet of paper P.

Here, intermediate transfer belt 42 and transfer roller 56 are brought into pressure-contact with a prescribed nip, and a voltage (high voltage of a polarity (+) opposite to the charged polarity (−) of the toner) for transferring the toner to the sheet of paper P is applied to transfer roller 56. Further, in order to constantly secure the nip mentioned above, a hard material (metal or the like) is used for one of the transfer roller 56 and intermediate transfer belt driving roller 44, and a soft material such as soft roller (elastic rubber roller, foam resin roller or the like) is used for the other one.

Further, as described above, the toner adhering to intermediate transfer belt 42 by the contact with photoreceptor drum 20, or toner not transferred to the sheet of recording paper by transfer roller 56 but left on intermediate transfer belt 42 may cause undesirable mixture of toner colors in succeeding process steps. Therefore, the toner adhering to or left on intermediate transfer belt 42 is removed and recovered by intermediate transfer belt cleaning unit 58. In intermediate transfer belt cleaning unit 58, a cleaning blade that is brought into contact with intermediate transfer belt 42 is provided as a cleaning member. Intermediate transfer belt 42 is supported by intermediate transfer belt driven roller 46 from the backside at a portion where the cleaning blade contacts.

The latent electrostatic image transferred to the sheet of paper P by transfer mechanism 40 is fed to fixing unit 50, at which the toner image is pressed and heated, whereby not-yet-fixed toner is melt and fixed on the sheet of paper P.

Fixing unit 50 includes a heat roller 52 and a pressure roller 54. Fixing unit 50 heats and melts not-yet fixed toner on the conveyed sheet of paper P by means of heat roller 52 at a portion of pressure contact, a so-called nip portion, between heat roller 52 and pressure roller 54, and by the anchoring function of pressure-contact force between heat roller 52 and pressure roller 54, fixes the not-yet-fixed toner on the sheet of paper P. At fixing unit 50, a heater (halogen heater or the like) is provided for heating heat roller 52.

In the vicinity of fixing unit 50, a paper discharge roller 24 for discharging the sheet of paper P to paper discharge tray 90 is provided.

Paper feed tray 62 is for containing sheets of paper P to be used for image formation, provided below exposure unit 32 in main body 110. Sheets of paper P to be used for image formation can also be placed on a manual feed tray 82. Discharge tray 90 provided at an upper portion of main body 110 is for stacking printed sheets of paper in a face-down manner.

In order to feed the sheets of paper from paper feed tray 62 or manual feed tray 82 through transfer roller 56 and fixing unit 50 to discharge tray 90, an approximately vertical paper conveying path S is provided in main body 110.

Paper conveying unit 70 has a conveying system for conveying the sheets of paper P. The conveying system includes a paper feeding system for feeding paper P from paper feed tray 62 to the paper conveying path S which leads to image forming unit 30, and a paper conveying system for conveying the paper P from the paper feeding system to the image forming unit 30 through paper conveying path S.

The paper feeding system of paper conveying unit 70 includes, in order to feed the sheets of paper P in paper feed tray 62 one by one to the paper conveying path S, a pick-up roller 64 and a paper feed roller 66 and a separation roller 68 positioned as a pair of upper/lower rollers to function as a separating roller pair. By the rotation of these rollers 64, 66 and 68, the sheets of paper P stacked and contained in paper feed tray 62 are picked-up one by one from the uppermost one and fed to the paper conveying system of paper conveying path S. The paper conveying system includes three pairs of conveyer rollers 140, 142 and 144. These conveyer roller pairs 140, 142 and 144 are arranged in this order from the upstream side to the downstream side of the paper conveying direction, on the paper conveying path S from the paper feeding system to registration roller pair 130. Pick-up roller 64, paper feed roller 66 and separation roller 68 are arranged at a paper discharging end of paper feed tray 62. The sheet of paper P fed from paper feed tray 62 to the paper conveying system by the operation of these rollers 64, 66 and 68 is conveyed by the rotation of conveyer roller pairs 140, 142 and 144 to registration roller pair 130 provided along the paper conveying path S.

Figure 2:
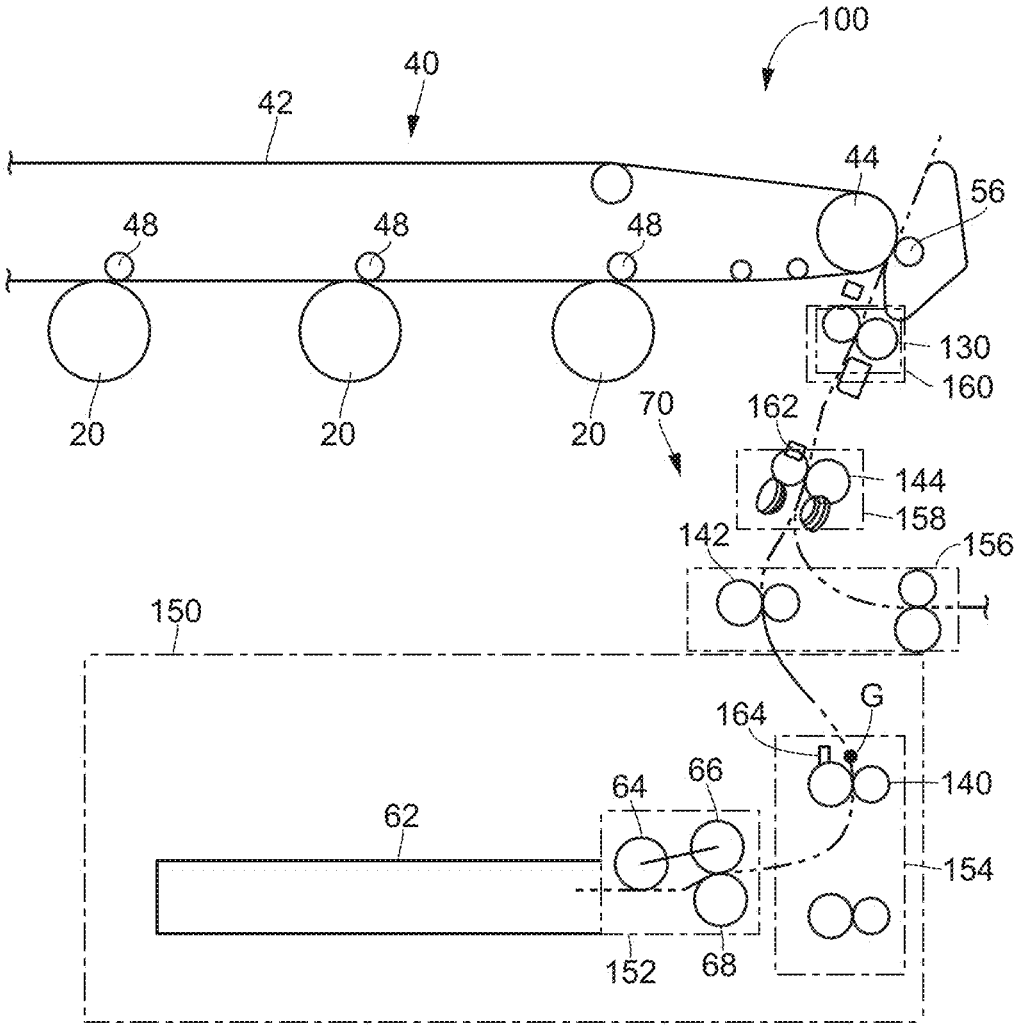
FIG. 2 schematically shows a configuration of a main portion of the paper conveying unit in the image forming apparatus shown in FIG. 1.

Referring to FIG. 2, paper conveying unit 70 further includes a paper feed motor 150, a paper feed clutch 152, a vertical conveying clutch 154, a conveying motor 156, a conveying motor 158 and a registration roller motor 160. Paper feed motor 150 drives pick-up roller 64, paper feed roller 66, separation roller 68 and conveyer roller pair 140. Paper feed clutch 152 transmits driving force of paper feed motor 150 to pick-up roller 64, paper feed roller 66 and separation roller 68. Vertical conveying clutch 154 transmits the driving force of paper feed motor 150 to conveyer roller pair 140. Paper feed clutch 152 and vertical conveying clutch 154 are electromagnetic, or electric clutch. When paper feed clutch 152 is turned on, the driving force of paper feed motor 150 is transmitted to pick-up roller 64, paper feed roller 66 and separation roller 68 and, hence, these rollers rotate. On the other hand, when paper feed clutch 152 is turned off, transmission of driving force of paper feed motor 150 is interrupted, and these rollers 64, 66 and 68 do not rotate. Similarly, when vertical conveying clutch 154 is turned on, the driving force of paper feed motor 150 is transmitted to conveyer roller pair 140, and conveyer roller pair 140 rotates. On the other hand, when vertical conveying clutch 154 is turned off, transmission of driving force of paper feed motor 150 is interrupted, and conveyer roller pair 140 does not rotate. Conveying motors 156 and 158 drive conveyer roller pairs 142 and 144, respectively. Registration roller motor 160 drives registration roller pair 130.

Registration roller pair 130 is for temporarily holding the sheet of paper P that is being conveyed through paper conveying path S. It has a function of conveying the sheet of paper P to transfer roller 56 at timing when the toner image on photoreceptor drum 20 is aligned with the leading edge of sheet P. More specifically, registration roller pair 130 has its operation controlled by registration roller motor 160 and a controller 170, shown in FIG. 8, such that the sheet of paper P is conveyed between intermediate transfer belt 42 and transfer roller 56 with the leading edge of sheet P fed from paper feed tray 62 aligned with the toner image on intermediate transfer belt 42.

In the vicinity of pre-registration conveyer roller 144 arranged before (on the upstream side of) registration roller pair 130, a first paper passage detection sensor 162 is provided. By the control of controller 170, if the first paper passage detection sensor 162 detects conveyance of a sheet of paper P, registration roller pair 130 is stopped at a timing a prescribed time period after the detection. Thus, the sheet of paper P is temporarily stopped at registration roller pair 130.

At a prescribed position near the conveyer roller pair 140 and on the upstream side of registration roller pair 130 in the paper conveying direction, a second paper passage detection sensor 164 is provided for detecting the state of conveyance of paper P. Pick-up roller 64, paper feed roller 66, separation roller 68 and conveyer roller pair 140 have their operations controlled by paper feed roller 66 and controller 170 shown in FIG. 8 such that if the second paper passage detection sensor 164 detects a leading edge of a sheet of paper P, the sheet of paper P is temporarily stopped at the timing of detection.

More specifically, when a plurality of sheets of paper P are fed successively to paper conveying path S and a leading edge of a sheet (succeeding sheet) is detected by the second paper passage detection sensor 164 while a preceding sheet is stopped at registration roller pair 130, image forming apparatus 100 temporarily stops the sheet. Therefore, the succeeding sheet is temporarily stopped at a prescribed position G on the downstream side of conveyer roller pair 140 in the paper conveying direction. The succeeding sheet is conveyed closer to the preceding sheet and kept standby at that position. Thereafter, the succeeding sheet is conveyed again toward registration roller pair 130 at a prescribed timing.

As the first and second paper passage detection sensors 162 and 164, a sensor detecting passage of a sheet of paper in non-contact manner, such as an optical sensor or an ultrasonic sensor, is used.

Paper feed tray 62 is provided with a sensor unit for detecting the size of paper P contained therein.

Figure 5:
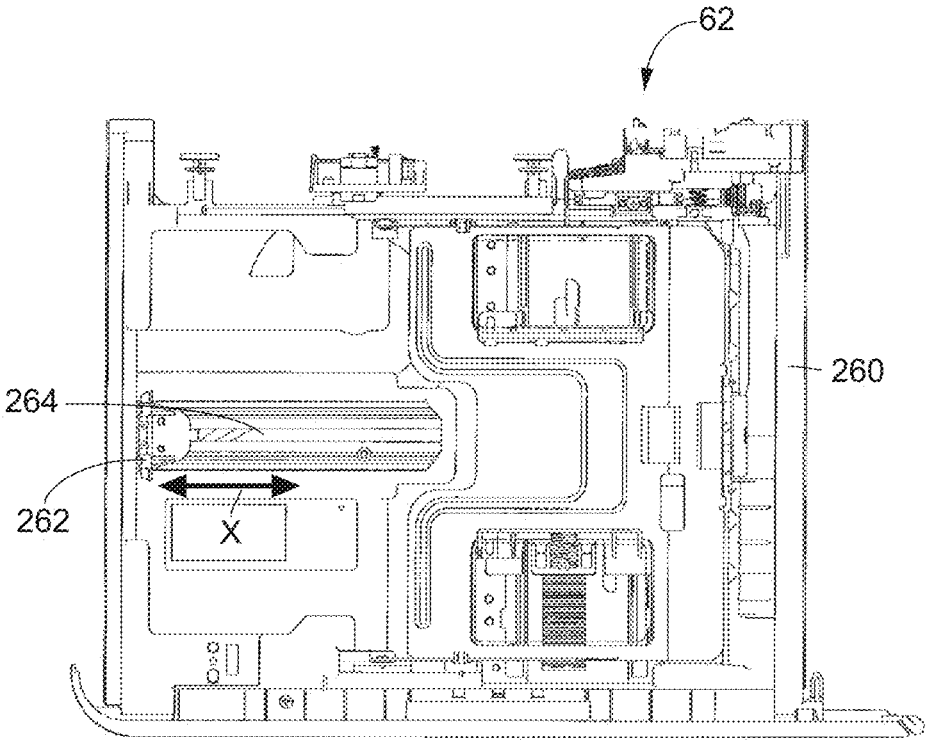
FIG. 5 is a plan view of a paper feed tray viewed from above.

Referring to FIGS. 5 and 6, paper feed tray 62 includes a frame 260, a paper trailing end plate 262 for aligning trailing ends of sheets of paper P contained therein, a spur gear 266 provided on the back side surface of paper feed tray 62, a paper size detection member 270, and a sensor unit 272. Paper trailing end plate 262 is provided movable in the direction of an arrow X along a sliding slit 264. Referring to FIG. 6, on the back side of paper trailing end plate 262, a pin 262*a* is provided, protruding downward. Spur gear 266 is pivotably supported by a pin 268, and it has a slit 266*a* to be engaged with a pin 262*a* of paper trailing end plate 262, and includes a gear portion 266*b*. Paper size detection member 270 includes a gear portion 270*a* to be engaged with the gear portion 266*b* of spur gear 266, and has notches 270*b* and 270*c*. Sensor unit 272 includes a plurality of (in the present embodiment, three) switches 272*a*. 272*b* and 272*c*. When paper trailing end plate 262 moves in the X direction along sliding slit 264, since pin 262*a* of paper trailing end plate 262 is engaged with the slit 266*a* of spur gear 266, spur gear 266 rotates in the direction M.

Referring to FIG. 7, spur gear 266 has its gear portion 266*b* engaged with gear portion 270*a* of paper size detection member 270 and, therefore, when spur gear 266 rotates, paper size detection member 270 moves in the X direction. Switches 272*a*, 272*b* and 272*c* of sensor unit 272 are arranged near paper size detection member 270. Each of the switches 272*a*, 272*b* and 272*c* is a push-type switch, and when paper size detection member 270 rotates and touches the switch, the switch of sensor unit 272 turns on. When paper size detection member 270 moves and notches 270*b* and 270*c* of paper size detection member 270 come to the positions of switches 272*a* and 272*c*, switches 272*a* and 272*c* turn off. By the combination of on/off of switches 272*a*, 272*b* and 272*c*, the size of contained paper P is detected. Here, the direction of arrangement of paper P is also detected and, hence, the length of paper P in the paper conveying direction is also detected.

When paper feed tray 62 is set in main body 110, sensor unit 272 transmits information related to the detected paper size to controller 170 shown in FIG. 8. Image forming apparatus 100 stores the information related to the paper size transmitted from sensor unit 272 to controller 170, for example, in RAM 176, in association with paper feed tray 62. Specifically, when sheets of paper of A4 size are stacked and contained in paper feed tray 62 and the paper feed tray 62 is set in main body 110, sensor unit 272 detects that the paper contained in paper feed tray 62 is of A4 size. RAM 176 stores that paper feed tray 62 contains paper of A4 size.

When a document is to be copy-printed, image forming apparatus 100 reads image information of the document by scanner unit 92 and, at that time, detects the paper size of the document. Receiving a detection signal related to the paper size, controller 170 shown in FIG. 8 looks up information related to the paper size stored in RAM 176 and selects a paper feed tray containing the sheet of paper having the received paper size, and feeds paper P from the selected paper feed tray to the paper conveying path S.

When printing is to be done based on image data transmitted from an external device such as a client PC 600, the image data (print data) transmitted from the external device includes a command indicating which size of paper is to be used for printing. Therefore, receiving the command (information related to the paper size), image forming apparatus 100 (controller 170) looks up the information related to the paper size stored in RAM 176, and selects the paper feed tray containing the paper of the size instructed by the received command. Then, paper is fed from the selected paper feed tray to the paper conveying path S.

Figure 3:
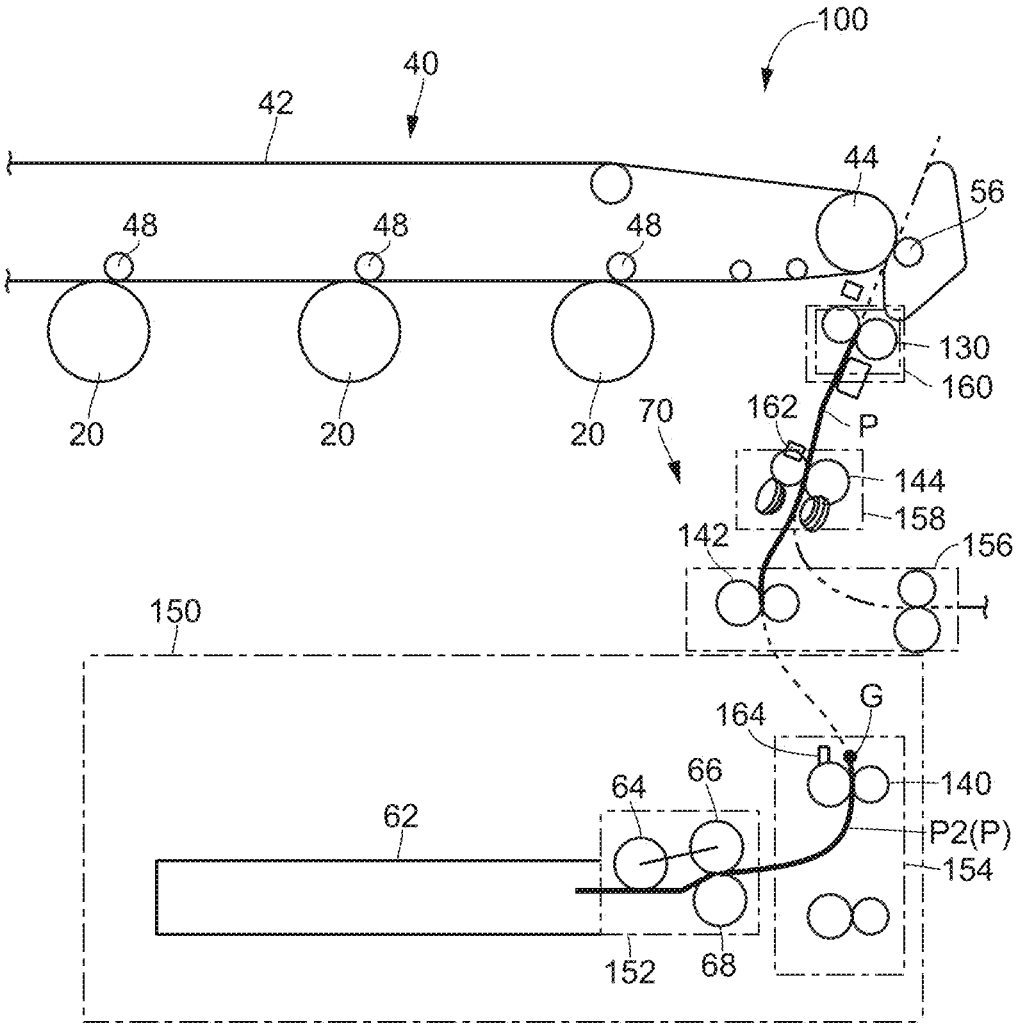
FIG. 3 schematically shows a configuration of a main portion of the paper conveying unit in the image forming apparatus shown in FIG. 1.

Referring to FIG. 3, if the length of conveyed sheet of paper P is longer than the distance (path length) from the nip portion between paper feed roller 66 and separation roller 68 to the position G at which the sheet P is temporarily stopped, it follows that when the leading edge of a sheet of paper P (P2) reaches the temporary stopping position G, the sheet of paper P2 is pinched at the nip portion between paper feed roller 66 and separation roller 68. Specifically, the succeeding sheet of paper P2 is retained at the nip portion between paper feed roller 66 and separation roller 68. In this situation, load of the paper feeding system is added on the succeeding sheet of paper P2 and, therefore, the load of the conveying system on the succeeding sheet of paper P2 increases. Because of the increased load, the succeeding sheet of paper tends to be more easily stopped at the temporary stop position G. Thus, the amount of deviation of paper P from the position G becomes very small, and the sheet of paper P substantially stops at the designed position.

Figure 4:
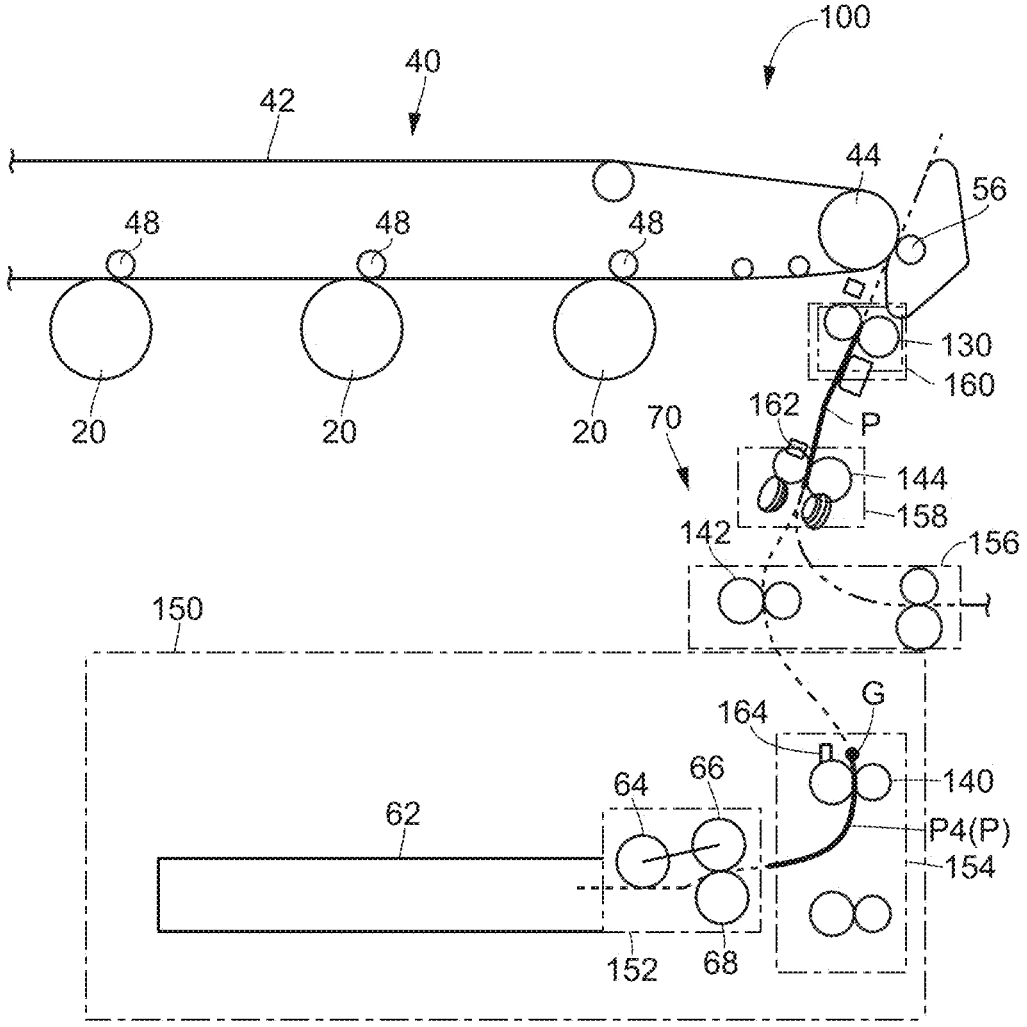
FIG. 4 schematically shows a configuration of a main portion of the paper conveying unit in the image forming apparatus shown in FIG. 1.

On the other hand, referring to FIG. 4, if the length of conveyed sheet of paper P is shorter than the distance (path length) from the nip portion between paper feed roller 66 and separation roller 68 to the position G at which the sheet P is temporarily stopped, it follows that when the leading edge of a sheet of paper P (P4) reaches the temporary stopping position G, the sheet of paper P4 is already out of the nip portion between paper feed roller 66 and separation roller 68 (completely freed from the nip portion). In this situation, the load of the paper feeding system is not exerted on the succeeding sheet of paper P4 and, therefore, the load on the succeeding sheet of paper P4 becomes smaller. It becomes more difficult to stop the succeeding sheet of paper P4 at the temporary stop position G and, therefore, the stop position of the leading edge of succeeding sheet of paper P4 is shifted to the downstream side than the temporary stop position G in the paper conveying direction. The amount of deviation is approximately constant, and it can be detected (measured) in advance by measurement. Data related to the timing to start re-conveyance of succeeding sheet of paper P4 considering the amount of deviation is stored in a storage unit of ROM 174, RAM 176 or HDD 178 (see FIG. 8). It is noted that if the length of paper P is shorter than the path length described above, the paper P is shifted to the downstream side of temporary stop position G in the paper conveying direction and, therefore, the timing to start re-conveyance is delayed by a prescribed time period than the pre-set (normal) timing.

As described above, depending on the length of conveyed sheet of paper, the position G at which the sheet is temporary stopped deviates. Specifically, the load of the conveying system differs depending on the length of conveyed paper, resulting in a difference in the stopping position.

In the present embodiment, the length of conveyed paper is detected and the timing to start re-conveyance of the succeeding sheet of paper is changed in accordance with the length. Specifically, if the length of paper P is longer than the path length mentioned above, the sheet stops at the temporary stop position G and, therefore, re-conveyance starts at the normal timing to start re-conveyance. On the other hand, if the length of sheet P is shorter than the path length mentioned above, re-conveyance starts at a timing of re-conveyance considering the amount of deviation. Thus, even when the stop position differs, the positional deviation can be corrected, and when reaching registration roller pair 130, variations in conveyance can be reduced. Thus, the interval between the sheets can be kept constant at the registration roller pair 130.

[Hardware Configuration]

Referring to FIG. 8, image forming apparatus 100 includes controller 170 for overall control of image forming apparatus 100.

Controller 170 is effectively a computer including a main CPU 172, an ROM 174, an RAM 176, an HDD (Hard Disk Drive) 178, an image memory and an image processing unit 182.

To main CPU 172, a common bus line 184 is connected, and to this bus line 184. ROM 174, RAM 176, HDD 178, image memory 180 and image processing unit 182 are connected.

Figure 9:
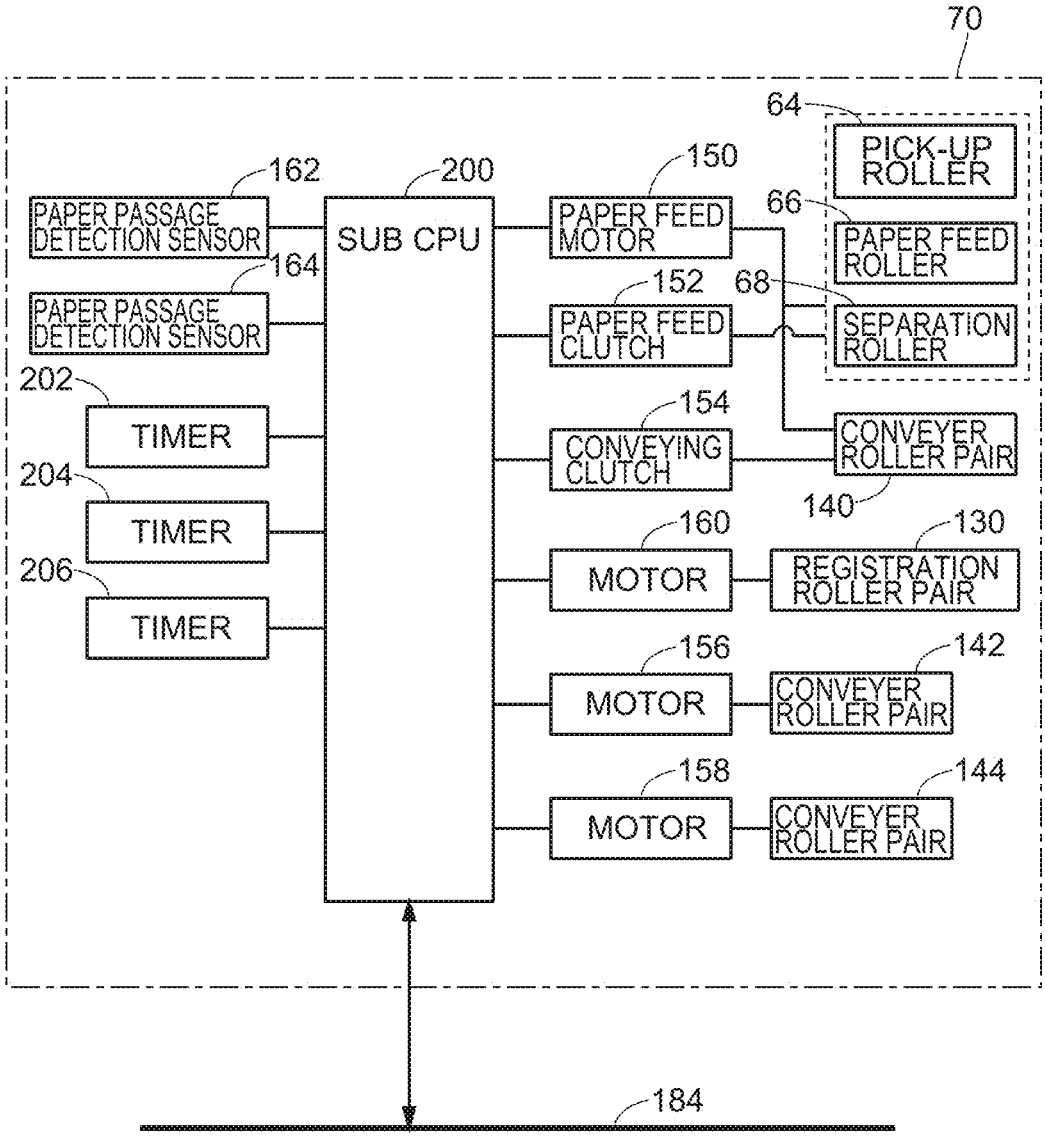
FIG. 9 is a block diagram showing an electrical configuration of the paper conveying unit.

Main CPU 172 executes a computer program for realizing the paper conveying process in accordance with the present embodiment, and thereby realizes the function of paper conveying unit 70 shown in FIG. 9. The program executed by main CPU 172 is stored in ROM 174 or HDD 178.

RAM 176 also stores information related to the size of paper P contained in paper feed tray 62, in association with paper feed tray 62. Specifically, RAM 176 stores which size of paper is contained in paper feed tray 62. The information related to the paper size includes paper size, the direction of paper arrangement and length of paper in the paper conveying direction.

At the time of execution, the program stored in ROM 174 or HDD 178 is read from ROM 174 or HDD 178 and loaded to RAM 176, read from an address in RAM 176 indicated by a register functioning as a program counter in main CPU 172, and interpreted and executed by main CPU 172. Data necessary for the execution is read from an address designated by an instruction of HDD 178, RAM 176 or the register mentioned above in main CPU 172. Similarly, the result of execution is also stored at an address designated by an instruction of HDD 178, RAM 176 or the register mentioned above in main CPU 172.

To common bus line 184, image forming unit 30, transfer mechanism 40, fixing unit 50, paper conveying unit 70, automatic document feeder 120 and scanner unit 92 are connected and, in addition, an operation unit 190 of image forming apparatus 100 and an NIC (Network Interface Card) 188 for providing an interface with a client PC 600 as an external device through a LAN (Local Area Network) line 610 are also connected. Therefore, main CPU 172 realizes desired operations of document reading, document output, paper feeding and discharging and communication with an external device such as client PC 600, and stores or reads data to/from RAM 176, HDD 178 and image memory 180, by controlling image forming unit 30, transfer mechanism 40, fixing unit 50, paper conveying unit 70, automatic document feeder 120, scanner unit 92 and NIC 188.

Operation unit 190 is provided on a front side of main body 110, and a start key 192, a display panel 194 and the like are provided on operation unit 190.

The conveyance program in accordance with the present embodiment is transmitted from another apparatus through LAN line 610 and NIC 188 to controller 170 substantially functioning as a computer, and stored in ROM 174 or HDD 178.

[Electric Configuration of Paper Conveying Unit 70]

Referring to FIG. 9, paper conveying unit 70 includes a sub CPU 200 as a center of control of paper conveying unit 70.

Sub CPU 200 is connected to a common bus line 184, and through bus line 184, it transmits/receives various data and the like to/from main CPU 172 shown in FIG. 8. To sub CPU 200 are connected: motors 150, 156 and 158 as driving sources, respectively, of three conveyer roller pairs 140, 142 and 144 forming the paper conveying system; registration roller motor 160 driving registration roller pair 130; paper passage detection sensors 162 and 164; and in addition, first, second and third timers 202, 204 and 206. To sub CPU 200 are further connected: a paper feed motor 150 as a driving source of each of pick-up roller 64, paper feed roller 66, separation roller 68 and conveyer roller pair 140; a paper feed clutch 152 transmitting driving force of paper feed motor 150 to pick-up roller 64, paper feed roller 66 and separation roller 68; and a vertical conveying clutch 154 transmitting driving force of paper feed motor 150 to conveyer roller pair 140. The motor as a driving source of conveyer roller pair 140 is the paper feed motor 150.

Sensing outputs of each of paper passage detection sensors 162 and 164, as well as time measurement outputs (time count values) of each of timers 202, 204 and 206 are applied to sub CPU 200. Based on the input sensing outputs of paper passage detection sensors 162 and 164 and time measurement outputs of timers 202, 204 and 206, sub CPU 200 controls driving of motors 150, 156, 158 and 160 and controls on/off of paper feed clutch 152 and conveying clutch 154.

It is noted that, in the present embodiment, paper conveying unit 70 and controller 170 function as the paper conveying device of the present invention.

[Software Configuration]

The present image forming apparatus 100 is programmed such that when a plurality of sheets of paper P are successively fed to the paper conveying path S and a preceding sheet of paper is temporarily stopped at registration roller pair 130, a succeeding, following sheet of paper is temporarily stopped at a prescribed position G downstream of conveyer roller pair 140 in the paper conveying direction, and when the succeeding sheet is to be re-conveyed at a prescribed timing, the timing to start re-conveyance is changed in accordance with the length of the paper (the length of the sheet of paper in the paper conveying direction).

The program used is stored in RAM 176 or HDD 178 of controller 170 and realizes various functions of image forming apparatus 100 as will be described in the following. These functions are realized by main CPU 172 in the above-described controller 170, which is effectively a computer, and sub CPU 200 in paper conveying unit 70 executing the program mentioned above. The program is activated when start key 192 for starting copy-printing is pressed, or when a print instruction is received from an external device.

Figure 10:
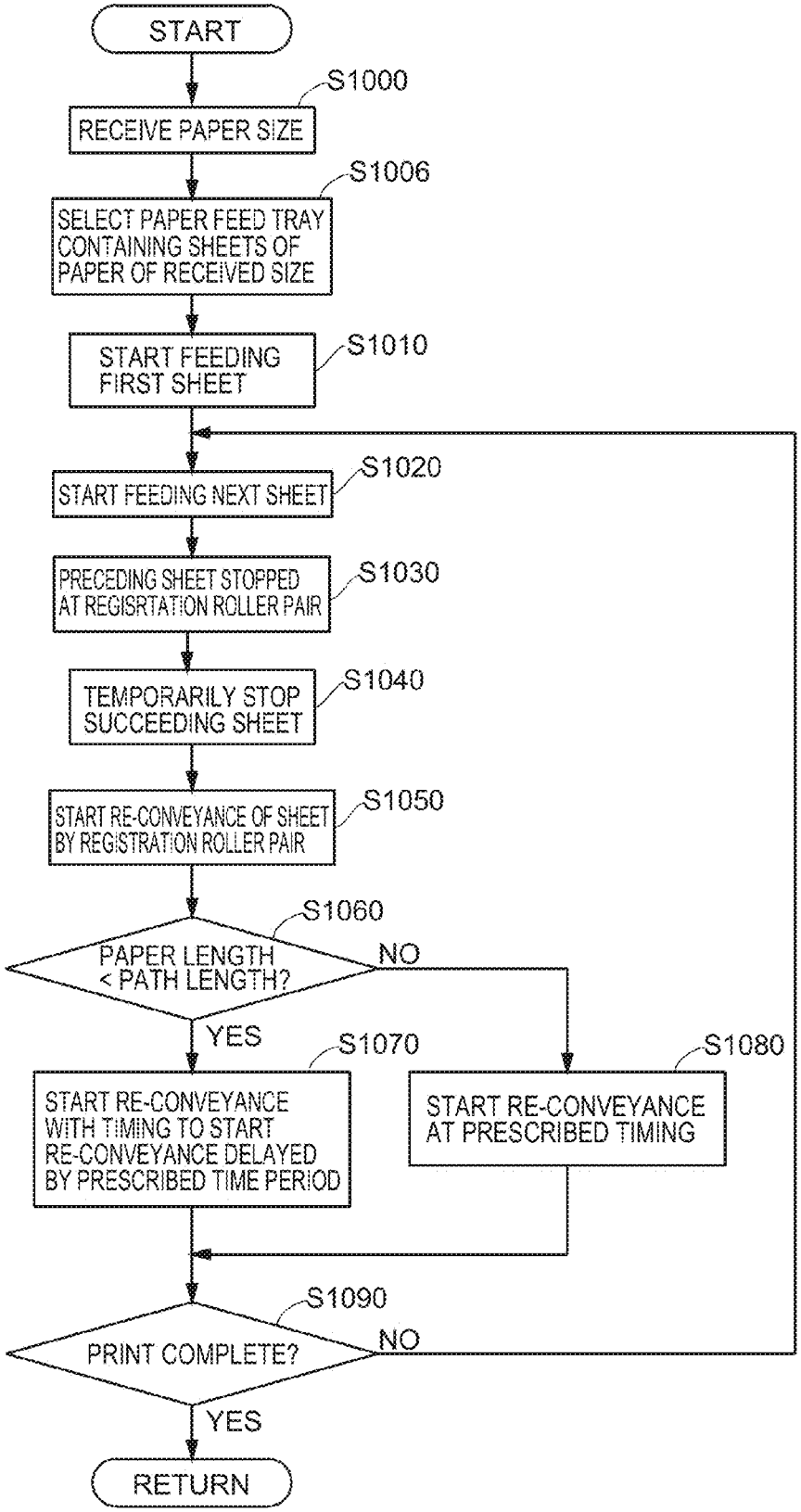
FIG. 10 is a flowchart representing a control structure of a program executed in the image forming apparatus shown in FIG. 1.

Referring to FIG. 10, the program includes: a step S1000 of receiving the information related to paper size; a step S1006, executed after step S1000, of selecting a paper feed tray containing the paper of received paper size; a step 1010, executed after step S1006, of feeding the first sheet of paper from the selected paper feed tray to the paper conveying path S; a step S1020, executed after step S1010, of feeding the next sheet to the paper conveying path S; a step S1030, executed after step S1020, of temporarily stopping the preceding sheet (preceding sheet) at registration roller pair 130; a step S1040, executed after step S1030, of temporarily stopping the succeeding sheet at a prescribed position G downstream of conveyer roller pair 140 in the paper conveying direction, while the preceding sheet of paper is stopped at registration roller pair 130; a step S1050, executed after step S1040, of starting re-conveyance of the sheet by registration roller pair 130; and a step S1060, executed after step S1050, of determining whether or not the paper length of the sheet of paper stopped at the position G is shorter than the distance (path length) from the nip portion between paper feed roller 66 and separation roller 68 to the temporary stop position G, and branching the flow of control depending on the result of determination.

Selection of paper feed tray at step S1006 takes place even when there is only one paper feed tray.

The program further includes: a step S1070, executed if it is determined at step S1060 that the paper length of the sheet is shorter than the path length, of delaying the timing to start re-conveyance by a prescribed time period and starting re-conveyance of the succeeding sheet of paper, a step S1080, executed if it is determined at step S1060 that the paper length is not shorter than the path length, of starting re-conveyance of the succeeding sheet of paper at a prescribed timing (normal timing to start re-conveyance); and a step S1090, executed after step S1070 or S1080, of determining whether all prints are completed, and branching the flow of control depending on the result of determination. If it is determined at step S1090 that all prints are completed, the program ends. If it is determined that not all prints are completed yet, the control returns to step S1020.

[Operation]

Figure 11:
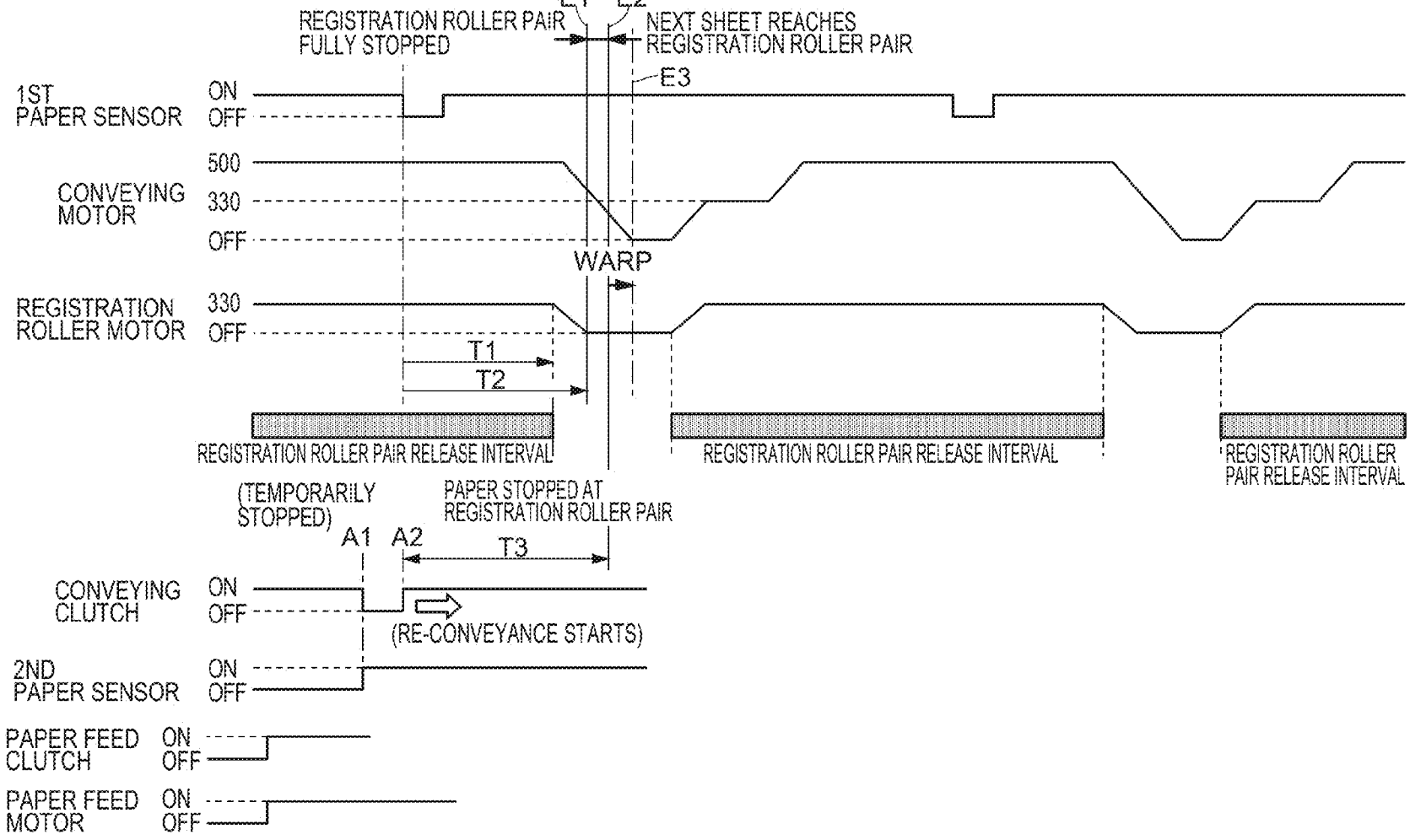
FIG. 11 is a timing chart representing a paper conveying operation at the paper conveying unit.

Referring to FIGS. 10 and 11, the operation of image forming apparatus 100 in accordance with the present embodiment, based on the above-described structure and the flowchart, will be described in the following. In the following, an example will be given in which sheets of paper contained in paper feed tray 62 are successively fed to paper conveying path S and printed. Further, in the following, the operation from feeding a sheet to paper conveying path S until the sheet is re-conveyed from registration roller pair 130 to image forming unit 30 will be described. General operations related to image formation are unrelated to the essential concept of the present invention and, therefore, description thereof will not be given here.

When start key 192 to start copying is pressed, or a print instruction is received from an external device, controller 170 receives the information related to the paper size (step S1000 shown in FIG. 10). Specifically, it receives an instruction related to which size of paper is to be used for printing. Receiving the information related to the paper size, image forming apparatus 100 selects the paper feed tray containing the paper of the received paper size, by looking-up the information related to the paper size stored in RAM 176 (step S1006).

When the paper feed tray is selected, the sheets of paper P in the selected paper feed tray 62 are successively fed one by one to the paper conveying path S. When the first sheet of paper is fed to the paper conveying path S (step S1010), the second sheet of paper is successively fed to the paper conveying path S (step S1020). The fed first sheet of paper is conveyed by the conveying system to the registration roller pair 130. When the first sheet reaches the registration roller pair 130, the first sheet of paper abuts the nip portion of registration roller pair 130 (step S1030). The sheet abutting the registration roller pair 130 warps and hence, skew is corrected.

Referring to the time chart of FIG. 11, paper feeding/conveying operation will be described in greater detail. Referring to FIG. 11, the numerical values on the ordinate on the side of "conveying motor" and "registration roller motor" represent paper feed speed (mm/sec).

When paper feed motor 150 and paper feed clutch 152 are turned on, pick-up roller 64, paper feed roller 66 and separation roller 68 rotate, and by the rotations of these rollers 64, 66 and 68, a sheet in paper feed tray 62 is fed to paper conveying path S. The fed paper is conveyed by the conveyer rollers at a feed speed of, for example, 500 mm/sec. When the conveyed sheet of paper turns off the first paper passage detection sensor 162, using this as a trigger, the first timer 202 starts time measurement and, after a time period T1, registration roller motor 160 stops. At timing E1, after a time period T2 from turning off of the first paper passage detection sensor 162 (first paper sensor), registration roller pair 130 is fully stopped. A prescribed time period after turning off of the first paper passage detection sensor 162, the conveying motor is turned off. At time E2, after timing E1 when the registration roller pair 130 is fully stopped, the sheet reaches registration roller pair 130. The timing E2 at which the sheet reaches registration roller pair 130 is set to be earlier than timing E3 when the conveying motor is fully stopped. Thus, the conveyed sheet abuts registration roller pair 130, of which rotation is stopped, and the sheets warps. Thereafter, at such a timing that the leading edge of toner image on photoreceptor drum 20 is aligned with the leading edge of paper P, the conveying motor and registration roller motor 160 are turned on, and registration roller pair 130 re-conveys the sheet between intermediate transfer belt 42 and transfer roller 56, at a feed speed (process speed) of, for example, 330 mm/sec. The timing of re-conveyance from registration roller pair 130 is measured by the second timer 204.

On the other hand, while the preceding sheet is stopped at registration roller pair 130, if the following, succeeding sheet turns on the second paper passage detection sensor 164 (second paper sensor), vertical conveying clutch 154 is turned off at that that timing A1, and the succeeding sheet is temporarily stopped at the position G. After a prescribed time period, at timing A2, vertical conveying clutch 154 is turned on and the succeeding sheet is conveyed toward registration roller pair 130.

As described above, depending on the size of conveyed paper (paper length in the direction of conveyance), the temporary stopping position may deviate from the position G. If the timing A2 to start re-conveyance toward registration roller pair 130 is kept constant regardless of such positional deviation, conveyance variation would result.

By way of example, assume that the succeeding sheet of paper is stopped deviated to the side more downstream in the conveying direction than the temporary stop position G. If the succeeding paper is re-conveyed and carried, the interval or space from the preceding sheet at the registration roller pair 130 will be too short, and the succeeding sheet will reach registration roller pair 130 before the registration roller pair 130 stops. In that case, the arriving sheet enters the nip portion of registration roller pair 130 and, therefore, skew correction fails. In addition, the sheet is fed earlier with respect to the image to be formed, off the timing of positional alignment and, hence, the image position will be varied.

In view of the foregoing, in the present embodiment, the paper length of the conveyed sheet of paper is detected, and whether the detected paper length is shorter than the above-described path length is determined (step S1060 shown in FIG. 10). Specifically, while the succeeding sheet of paper is temporarily stopped, whether the sheet is pinched at the nip portion between paper feed roller 66 and separation roller 68 is detected, based on the paper length of the sheet.

If the detected paper length is shorter than the above-mentioned path length (YES at step S1060), the timing A2 to start re-conveyance (see FIG. 1) is delayed by a prescribed time period than the normal timing (the time period T3 from the timing A2 to start re-conveyance until the timing E2 at which the succeeding sheet reaches registration roller pair 130 is made shorter). On the other hand, if the detected paper length is longer than the above-mentioned path length, the timing A2 to start re-conveyance is unchanged from the normal timing. Thus, the interval between sheets of paper at registration roller pair 130 can be kept constant.

The above-described paper conveying operation is repeated until all image data is printed.

[Effects of the Present Embodiment]

As is apparent from the foregoing description, use of image forming apparatus 100 in accordance with the present embodiment attains the following effects.

While the preceding sheet of paper is stopped at registration roller pair 130, the following, succeeding sheet of paper is temporarily stopped at prescribed position G downstream of conveyer roller pair 140 in the paper conveying direction. It follows that the succeeding sheet of paper is conveyed closer to the preceding sheet and kept in the standby state at that position. Then, at a prescribed timing the sheet is re-conveyed toward the registration roller pair 130. Thus, the interval between the preceding and succeeding sheets of paper can easily be made shorter.

When the succeeding sheet of paper is temporarily stopped, the load of the conveying system exerted on the succeeding sheet of paper may differ depending on the paper length of the sheet (paper length of the sheet in the paper conveying direction). Therefore, positional deviation results at the temporary stop position G, in accordance with the paper length of the conveyed sheet of paper. Specifically, the load of conveying system differs depending on the paper length of the conveyed sheet of paper, causing difference in the stop position. If the timing to start re-conveyance toward registration roller pair 130 is kept constant regardless of such positional deviation, variation in conveyance would be caused.

In image forming apparatus 100 (paper conveying unit 70) in accordance with the present embodiment, the timing to start re-conveyance of succeeding sheet of paper is changed in accordance with the paper length of the conveyed sheet of paper. Thus, the interval between the sheets at registration roller pair 130 can be kept constant. Consequently, even when CPM is increased, variation in conveyance can be reduced. Since variation in conveyance is reduced, it becomes possible to temporarily stop the conveyed sheet of paper and re-convey the sheet reliably at registration roller pair 130. Thus, successful skew correction of the sheet of paper becomes possible, and the timing of registration can successfully be adjusted to align the reference of leading edge of the paper. This prevents degradation of print quality. As a result, the number of prints per unit time (CPM) can be increased as much as possible while not very much increasing the speed of image formation in copy-printing (process speed) (with the process speed kept as low as possible), and the productivity can be improved.

Whether or not the paper length of conveyed sheet of paper is shorter than the path length from the nip portion between paper feed roller 66 and separation roller 68 to the position G at which the succeeding sheet of paper is temporarily stopped is determined, and if the paper length of conveyed sheet of paper is determined to be shorter than the path length, the timing to start re-conveyance of succeeding sheet of paper is delayed by a prescribed time period. Thus, the interval between the sheets of paper at registration roller pair 130 can easily be kept constant. If the paper length of conveyed sheet of paper is determined to be not shorter (longer) than the path length, it follows that the succeeding sheet tends to stop easily at the temporary stop position. Therefore, positional deviation at that position is unlikely. Therefore, in this situation, the timing to start re-conveyance of succeeding sheet of paper is unchanged, and thus, the interval between the sheets of paper at registration roller pair 130 can easily be kept constant. By the above-described configuration, variation in conveyance can easily be reduced.

The effects described above will be noticeable felt in a high-speed apparatuses capable of high-speed printing.

(Second Embodiment)

Figure 12:
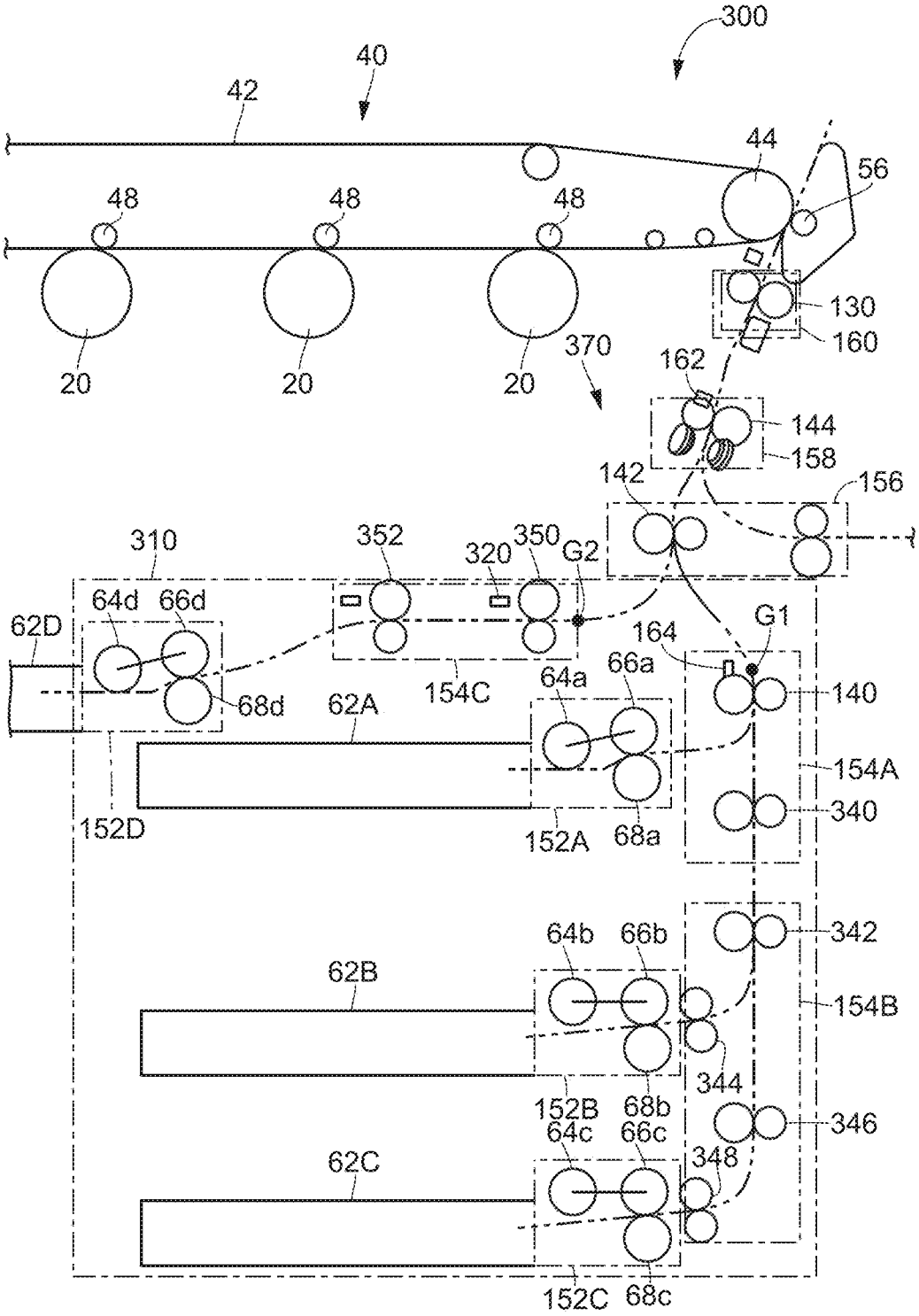
FIG. 12 schematically shows a configuration of a main portion of the paper conveying unit in the image forming apparatus in accordance with a second embodiment of the present invention.

Referring to FIG. 12, an image forming apparatus 300 in accordance with the present embodiment differs from the above-described first embodiment in that multi-stage paper feed trays 62A, 62B, 62C and 62D capable of containing a plurality of sheets of paper are provided.

[Overall Configuration]

Image forming apparatus 300 includes, in place of paper conveying unit 70 of the first embodiment, a paper conveying unit 370. Paper conveying unit 370 includes a conveying system for conveying sheets of paper contained in multi-stage paper feed trays 62A, 62B, 62C and 62D. The conveying system includes four paper feed systems for feeding sheets of paper from multi-stage paper feed trays 62A, 62B, 62C and 62D to the paper conveying path toward image forming unit 30, and a paper conveying system for conveying the sheets of paper from each of these paper feed systems through the paper feed path to image forming unit 30.

The first paper feed system includes, in order to feed sheets of paper contained in the upper-most, first paper feed tray 62A one by one to the paper conveying path, a pick-up roller 64*a*, and a paper feed roller 66*a* and a separation roller 68*a* positioned as a pair of upper/lower rollers to function as a separating roller pair. By the rotation of these rollers 64*a*, 66*a* and 68*a*, the sheets of paper P stacked and contained in the first paper feed tray 62A are picked-up one by one from the uppermost one and fed to the paper conveying path. Pick-up roller 64*a*, paper feed roller 66*a* and separation roller 68*a* are arranged at a paper discharging end of the first paper feed tray 62A. The sheet of paper P fed from the first paper feed tray 62A to the paper conveying system by the operation of these rollers 64*a*. 66*a* and 68*a* is conveyed by the conveying system to registration roller pair 130 provided along the paper conveying path.

The second paper feed system includes, in order to feed sheets of paper contained in the middle, second paper feed tray 62B one by one to the paper conveying path, a pick-up roller 64*b*, and a paper feed roller 66*b* and a separation roller 68*b* positioned as a pair of upper/lower rollers to function as a separating roller pair. By the rotation of these rollers 64*b*, 66*b* and 68*b*, the sheets of paper P stacked and contained in the second paper feed tray 62B are picked-up one by one from the uppermost one and fed to the paper conveying path. Pick-up roller 64*b*, paper feed roller 66*b* and separation roller 68*b* are arranged at a paper discharging end of the second paper feed tray 62B. The sheet of paper P fed from the second paper feed tray 62B to the paper conveying system by the operation of these rollers 64*b*, 66*b* and 68*b* is conveyed by the conveying system to registration roller pair 130 provided along the paper conveying path.

The third paper feed system includes, in order to feed sheets of paper contained in the lowermost, third paper feed tray 62C one by one to the paper conveying path, a pick-up roller 64*c*, and a paper feed roller 66*c* and a separation roller 68*c* positioned as a pair of upper/lower rollers to function as a separating roller pair. By the rotation of these rollers 64*c*. 66*c* and 68*c*, the sheets of paper P stacked and contained in the third paper feed tray 62C are picked-up one by one from the uppermost one and fed to the paper conveying path. Pick-up roller 64*c*, paper feed roller 66*c* and separation roller 68*c* are arranged at a paper discharging end of the third paper feed tray 62C. The sheet of paper P fed from the third paper feed tray 62C to the paper conveying system by the operation of these rollers 64*c*, 66*c* and 68*c* is conveyed by the conveying system to registration roller pair 130 provided along the paper conveying path.

The fourth paper feed system includes, in order to feed sheets of paper contained in the fourth paper feed tray 62D, provided parallel to the uppermost, first paper feed tray 62A, one by one to the paper conveying path, a pick-up roller 64*d*, and a paper feed roller 66*d* and a separation roller 68*d* positioned as a pair of upper/lower rollers to function as a separating roller pair. By the rotation of these rollers 64*d*, 66*d* and 68*d*, the sheets of paper P stacked and contained in the fourth paper feed tray 62D are picked-up one by one from the uppermost one and fed to the paper conveying path. Pick-up roller 64*d*, paper feed roller 66*d* and separation roller 68*d* are arranged at a paper discharging end of the fourth paper feed tray 62D. The sheet of paper P fed from the fourth paper feed tray 62D to the paper conveying system by the operation of these rollers 64*d*, 66*d* and 68*d* is conveyed by the conveying system to registration roller pair 130 provided along the paper conveying path.

Paper conveying unit 370 further includes conveyer rollers 140, 142, 144, 340 to 352 for conveying sheets of paper fed from multi-stage paper feed trays 62A, 62B, 62C and 62D. Conveyer rollers 340 to 352 and the first to fourth paper feed systems are driven by paper feed motor 310 as a driving source. In the first paper feed system, the driving force of paper feed motor 310 is transmitted by a paper feed clutch 152A. In the second paper feed system, the driving force of paper feed motor 310 is transmitted by a paper feed clutch 152B. In the third paper feed system, the driving force of paper feed motor 310 is transmitted by a paper feed clutch 152C. In the fourth paper feed system, the driving force of paper feed motor 310 is transmitted by a paper feed clutch 152D.

The sheet of paper fed from the first paper feed tray 62A is conveyed, by way of example, by three pairs of conveyer rollers 140, 142 and 144. The sheet of paper fed from the second paper feed tray 62B is conveyed, by way of example, by six pairs of conveyer rollers 344, 342, 340, 140, 142 and 144. The sheet of paper fed from the third paper feed tray 62C is conveyed, by way of example, by seven pairs of conveyer rollers 348, 346, 342, 340, 140, 142 and 144. The sheet of paper fed from the fourth paper feed tray 62D is conveyed, by way of example, by four pairs of conveyer rollers 352, 350, 142 and 144.

To conveyer roller pairs 140 and 340, the driving force of paper feed motor 310 is transmitted by a vertical conveying clutch 154A. To conveyer roller pairs 342, 344, 346 and 348, the driving force of paper feed motor 310 is transmitted by a vertical conveying clutch 154B. To conveyer roller pairs 350 and 352, the driving force of paper feed motor 310 is transmitted by a relaying conveying clutch 154C.

Each of these clutches is an electromagnetic or electric clutch, and when the clutch is turned on, the driving force of paper feed motor 310 is transmitted and when the clutch is turned off, transmission of the driving force of paper feed motor 310 is stopped.

In the vicinity of conveyer roller pair 140, at a position upstream of registration roller pair 130, a second paper passage detection sensor 164 is provided. A sheet of paper fed from any of the first, second, and third paper feed trays 62A, 62B and 62C has its state of conveyance detected by the second paper passage detection sensor 164, and the conveyed sheet of paper is temporarily stopped at the timing of detection. Specifically, when the second paper passage detection sensor 164 detects the leading edge of succeeding (following)

sheet of paper, the sheet of paper is temporarily stopped at the timing of detection. Thus, the succeeding sheet of paper temporarily stops at a prescribed position G1 downstream of conveyer roller pair 140 in the paper conveying direction. Thereafter, the succeeding sheet of paper is re-conveyed toward registration roller pair 130 at a prescribed timing.

In the vicinity of conveyer roller 350, at a position upstream of registration roller pair 130, a third paper passage detection sensor 320 is provided. A sheet of paper fed from the fourth paper feed tray 62D has its state of conveyance detected by the third paper passage detection sensor 320, and the conveyed sheet of paper is temporarily stopped at a prescribed time period after the detection of the leading edge of the sheet. Specifically, when the third paper passage detection sensor 320 detects the leading edge of succeeding (succeeding) sheet of paper, the sheet of paper is temporarily stopped at the timing a prescribed time period after the detection. Thus, the succeeding sheet of paper temporarily stops at a prescribed position G2 downstream of conveyer roller 350 in the paper conveying direction. Thereafter, the succeeding sheet of paper is re-conveyed toward registration roller pair 130 at a prescribed timing.

Therefore, as to the sheets fed from the first, second and third paper feed trays 62A. 62B and 62C, the position where the sheet is temporarily stopped while the preceding sheet of paper is temporarily stopped at registration roller pair 130 is the position G1. On the other hand, as to the sheet of paper fed from the fourth paper feed tray 62D, the position where the sheet is temporarily stopped while the preceding sheet of paper is temporarily stopped at registration roller pair 130 is the position G2.

As described above, in the present embodiment, the distance (path length) from the nip portion between the paper feed roller and the separation roller to the position where the sheet is temporarily stopped differs tray by tray. The path length for each tray is stored in a storage unit such as ROM 174, RAM 176 or HDD 178, in association with the paper feed tray. Thus, when a desired paper feed tray is selected to select desired sheets of paper, the path length corresponding to the selected paper feed tray is detected.

In the present embodiment, as in the first embodiment described above, information related to the paper size of sheets of paper contained in respective paper feed trays 62A, 62B, 62C and 62D is stored in RAM 176 in association with respective paper feed trays. When the information related to the paper size of a document of which image information is to be read by scanner unit 92 is received, or when a command related to the paper size included in the image data transmitted from an external device such as client PC 600 is received, image forming apparatus 300 selects a paper feed tray containing the sheets of paper of the paper size corresponding to the received information related to the paper size, from among the plurality of paper feed trays, by looking up the information related to the paper size stored in RAM 176. When any of the paper feed trays is selected, the above-described path length corresponding to the selected paper feed tray is detected.

Figure 13:
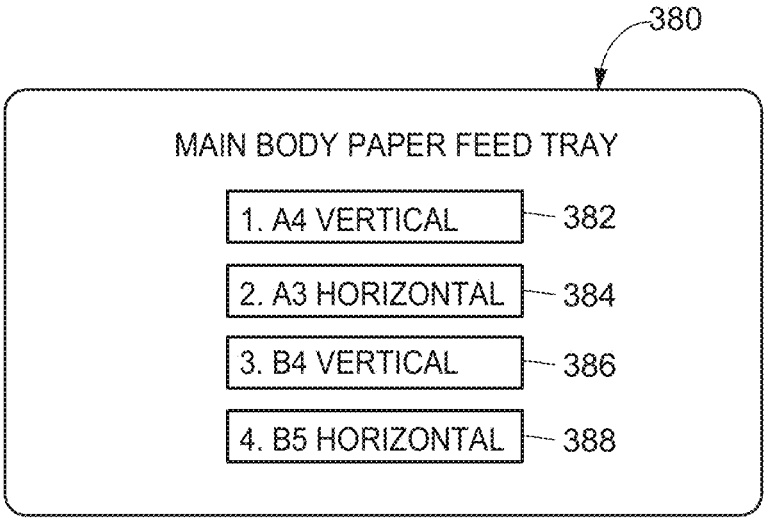
FIG. 13 shows an example of a paper selection screen image.

Selection of paper is also possible by an operation of paper selection screen image 380 displayed on operation unit 190 (display panel 194) of image forming apparatus 300. Referring to FIG. 13, on paper selection screen image 380, selection keys 382 to 388 allowing selection of multi-stage paper feed trays 62A, 62B, 62C and 62D are displayed. For example, if selection key 382 is operated, the first paper feed tray 62A is selected; if selection key 384 is operated, the second paper feed tray 62B is selected; if selection key 386 is operated, the third paper feed tray 62C is selected; and if selection key 388 is operated, the fourth paper feed tray 62D is selected. If any of the multi-stage paper feed trays 62A, 62B, 62C and 62D is selected by an operation of paper selection screen image 380, the above-described path length corresponding to the selected paper feed tray is also detected.

If printing is to be executed in accordance with a print instruction from an external device, the configuration allows selection of any of the multi-stage paper feed trays 62A, 62B, 62C and 62D on a screen image of a user interface of a printer driver displayed on a display device (not shown) of the external device. Here, the path length and the paper size (paper length in the paper conveying direction) corresponding to the selected paper feed tray are detected from the image data transmitted from the external device.

In the present embodiment, the paper length of conveyed sheet of paper, and the path length from the nip portion between the paper feed roller and the separation roller to the position where the sheet is temporarily stopped are detected, and based on the paper length and the path length, the timing to start re-conveyance of the succeeding sheet of paper is changed.

[Software Configuration]

Figure 14:
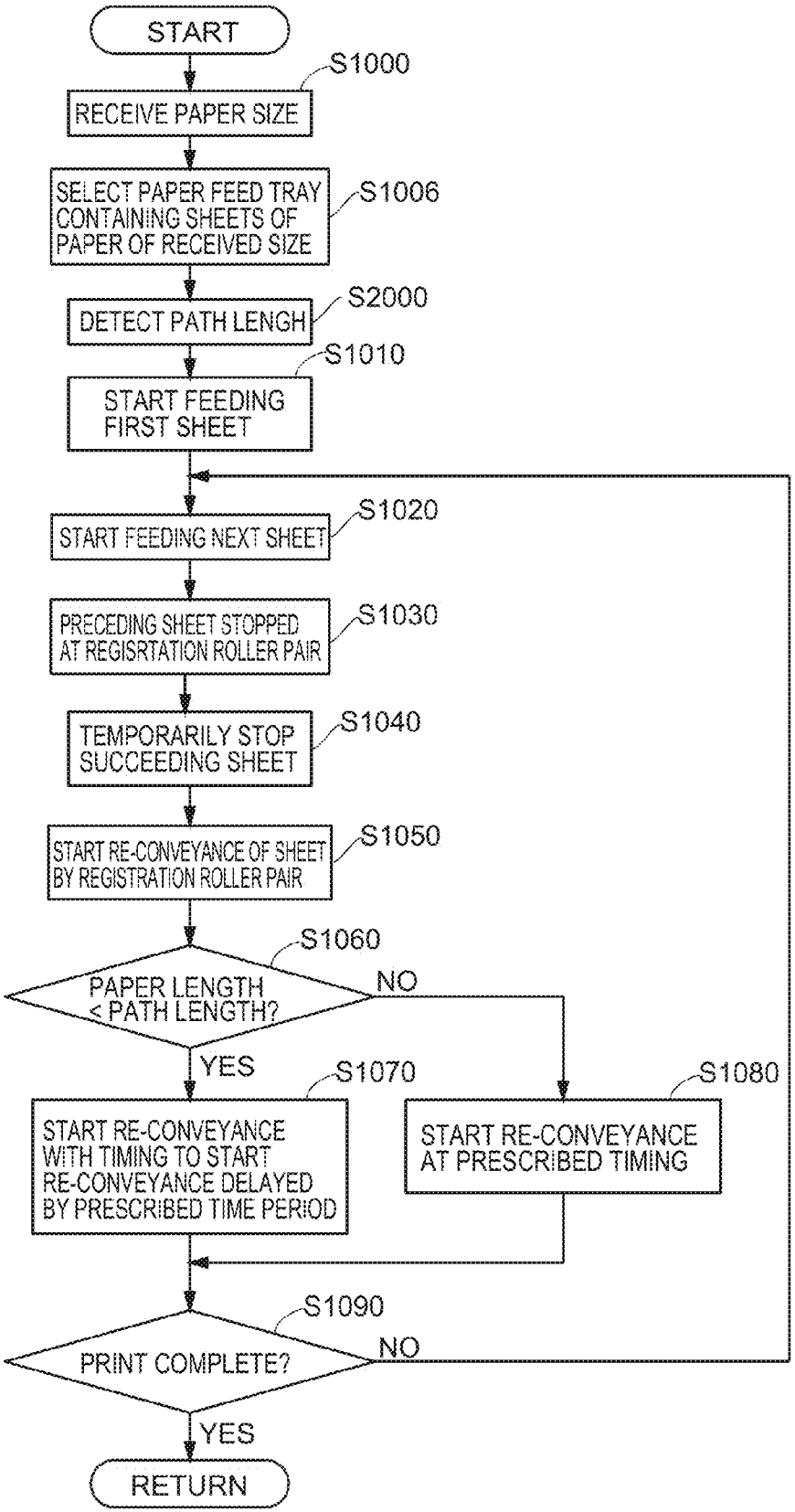
FIG. 14 is a flowchart representing a control structure of a program executed by the image forming apparatus in accordance with the second embodiment.

Referring to FIG. 14, in image forming apparatus 300 in accordance with the present embodiment, the process steps except for step S2000 are the same as those executed by the computer program shown in FIG. 10. In the following, the difference will be described.

The program includes a step S2000, executed after step S1006, of detecting a distance (path length) from the nip portion between the paper feed roller and the separation roller to the position where the sheet is temporarily stopped. At step S2000, in accordance with the selected paper feed tray, the path length for the paper feed tray is detected. When the process of step S2000 is done, the control proceeds to step S1010.

[Operation]

Referring to FIGS. 12 to 14, the operation of image forming apparatus 300 in accordance with the present embodiment, based on the above-described structure and the flowchart, will be described in the following. It is noted that the operations except for the operation of detecting the path length are the same as those of the first embodiment described above. Therefore, detailed description of the same operations will not be repeated.

When start key 192 to start copying is pressed, or a print instruction is received from an external device, controller 170 receives the information related to the paper size (step S1000 shown in FIG. 14). Specifically, it receives an instruction related to which size of paper is to be used for printing. Receiving the information related to the paper size, image forming apparatus 100 selects the paper feed tray containing the paper of the received paper size, by looking-up the information related to the paper size stored in RAM 176, from multi-stage paper feed trays 62A, 62B, 62C and 62D (step S1006). When the paper feed tray is selected, the above-described path length corresponding to the selected paper feed tray is detected (step S2000).

If the paper (paper feed tray) is to be selected by the operation of paper selection screen image 380, the user first causes operation unit 190 to display paper selection screen image 380 (see FIG. 13). The user can designate a desired paper feed tray by operating the paper selection screen image 380. On respective selection keys 382 to 388 on paper selection screen image 380, the paper size and orientation of sheets of paper contained in paper feed trays 62A, 62B, 62C and 62D are displayed. By operating any of selection keys 382 to 388, the paper feed tray containing sheets of paper of the desired size is selected. The sheets of paper contained in the selected paper feed tray are designated as the paper for printing.

When start key 192 to start copying is pressed, or a print instruction is received from an external device, the information related to the paper size is received (step S1000). Here, the paper size of the designated sheets of paper mentioned above is received as the information related to the paper size. Since the sheets of paper of the received paper size are contained in the designated paper feed tray, the designated paper feed tray is selected from multi-stage paper feed trays 62A. 62B, 62C and 62D (step S1006). When the paper feed tray is selected, the path length corresponding to the selected paper feed tray is detected (step S2000).

If printing is to be executed in accordance with a print instruction from an external device, it is possible to select any of the multi-stage paper feed trays 62A. 62B, 62C and 62D on a screen image of a user interface of a printer driver displayed on a display device of the external device. Here, the paper length and the path length are detected from the image data (print data) transmitted from the external device.

Thereafter, the paper conveying operation similar to that of the first embodiment is executed.

[Effects of the Present Embodiment]

As is apparent from the description above, use of image forming apparatus 300 in accordance with the present embodiment attains the following effects.

Based on the path length from the nip portion between the paper feed roller and the separation roller to the position where the sheet is temporarily stopped and on the paper length of the conveyed sheet of paper, the timing to start re-conveyance of the succeeding sheet of paper is changed and, therefore, even when the path length is different, variation in conveyance can be reduced.

For any sheet of paper fed from the plurality of paper feed trays to the paper conveying path, the sheet is stopped at the timing when the second paper passage detection sensor 164 detects the leading edge of the sheet. Thus, any sheet of paper fed from the plurality of paper feed trays to the paper conveying path is stopped temporarily at the prescribed position G1 downstream of conveyer roller pair 140 in the paper conveying direction. Thus, any sheet of paper fed from the plurality of paper feed trays to the paper conveying path comes to be temporarily stopped at the same position. Thus, when the timing to start re-conveyance of the succeeding sheet of paper is to be changed in accordance with the paper length of conveyed sheet of paper, the timing to start re-conveyance can be changed easily. In additions, any sheet of paper fed from the plurality of paper feed trays to the paper conveying path can be conveyed closer to the preceding paper and kept standby at that position.

Other effects are the same as those of the first embodiment.

(Third Embodiment)

In the present embodiment, different from the first and second embodiments described above, the amount of positional deviation of a succeeding sheet of paper at the temporary stopping position is measured and, in accordance with the measured amount of deviation, the timing to start re-conveyance of the succeeding sheet of paper is changed.

The image forming apparatus in accordance with the present embodiment has the same hardware configuration as that of the image forming apparatus 300 in accordance with the second embodiment. The program and the like stored in RAM 176 or HDD 178 of controller 170 are different.

Referring to FIG. 12, the method of measuring the amount of deviation of succeeding sheet of paper will be described. In the following, an example will be given in which sheets of paper are fed from any of the first, second and third paper feed trays 62A. 62B and 62C and the succeeding sheet of paper is temporarily stopped at position G1.

When a fed sheet of paper turns off the second paper passage detection sensor 164, conveyance of the sheet of paper is stopped at this timing, and the sheet is temporarily stopped at position G1. When the sheet is re-conveyed at a prescribed timing and the trailing edge of the sheet passes over the second paper passage detection sensor 164, the second paper passage detection sensor 164 turns on. At that timing, a timer, not shown, starts measurement. When the leading edge of the conveyed sheet of paper reaches the first paper passage detection sensor 162, the first paper passage detection sensor turns off. At this timing, measurement by the timer is stopped.

In a storage unit such as RAM 176 or HDD 178, a reference time (required time when there is no positional deviation) from the turning on of second paper passage detection sensor 164 to the turning off of first paper passage detection sensor 162 for each paper size (for each paper length in the paper conveying direction) is stored.

If there is any positional deviation at the position G1, the time from turning on of second paper passage detection sensor 164 to the turning off of first paper passage detection sensor 162 becomes different from the reference time. By way of example, if there is a downstream side positional deviation of sheet in the paper conveying direction at position G1, the time from turning on of second paper passage detection sensor 164 to the turning off of first paper passage detection sensor 162 becomes shorter than the reference time. Therefore, by comparing the time from turning on of second paper passage detection sensor 164 to the turning off of first paper passage detection sensor 162 with the reference time, the amount of deviation can be measured.

The amount of deviation can also be measured in the similar manner as described above when sheets of paper are fed from the fourth paper feed tray 62D and the succeeding sheet of paper is temporarily stopped at position G2.

[Software Configuration]

Figure 15:
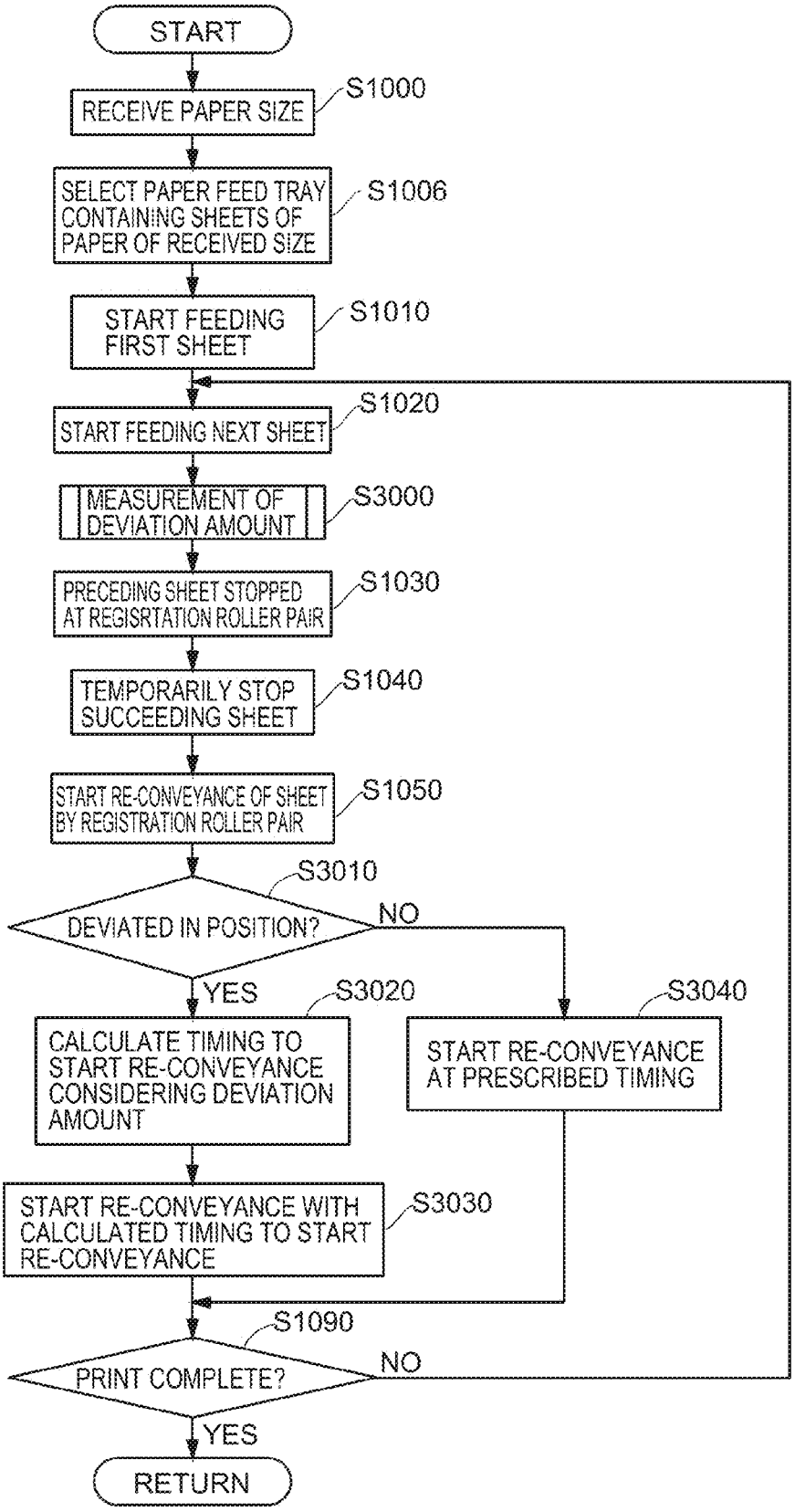
FIG. 15 is a flowchart representing a control structure of a program executed by the image forming apparatus in accordance with the third embodiment.

Referring to FIG. 15, in the image forming apparatus in accordance with the present embodiment, the process steps except for steps S3000, S3010, S3020, S3030 and S3040 are the same as those executed by the computer program shown in FIG. 10. In the following, the difference will be described.

The program includes: a step S3000, executed after step S1020, of measuring amount of positional deviation of the succeeding sheet of paper and causing the control flow to proceed to step S1030; a step S3010, executed after step S1050, of determining whether or not there is any positional deviation caused, based on the result of measurement of positional deviation at step S3000, and branching the flow of control depending on the result of determination; a step S3020, executed if it is determined at step S3010 that there is a positional deviation, of calculating the timing to start re-conveyance in consideration of the amount of deviation; a step S3030, executed after step S3020, of starting re-conveyance of the succeeding sheet of paper at the calculated timing to start re-conveyance; and a step S3040, executed if it is determined at step S3010 that there is no positional deviation, of starting re-conveyance of the succeeding sheet of paper at the prescribed timing (normal timing to start re-conveyance). When the process at step S3030 or S3040 ends, the control proceeds to step S1090.

Figure 16:
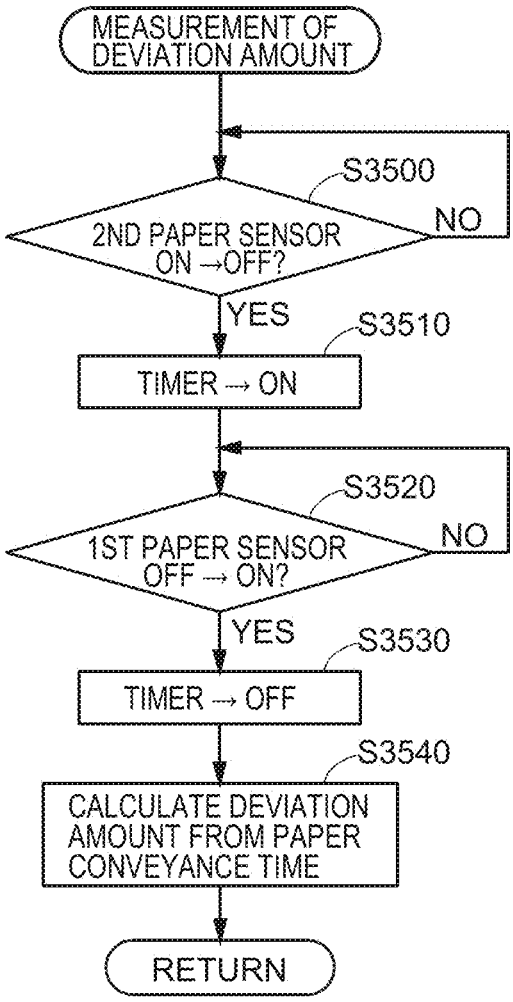
FIG. 16 is a detailed flow of step S3000 shown in FIG. 15.

FIG. 16 is a detailed flowchart of step S3000 shown in FIG. 15. With reference to FIG. 16, the flow of the process for measuring amount of deviation when sheets of paper are fed from any of the first, second and third paper feed trays 62A, 62B and 62C will be described.

Referring to FIG. 16, the routine includes: a step 3500 of determining whether or not the second paper passage detection sensor 164 is turned from on to off, and waiting until the second paper passage detection sensor 164 is turned off; a step S3510, executed if it is determined at step S3500 that the second paper passage detection sensor 164 is turned off, of turning on the timer and starting measurement at the timing of turning off; a step S3520, executed after step S3510, of determining whether the first paper passage detection sensor 162 is turned from off to on, and waiting until the first paper passage detection sensor 162 is turned on; a step S3530, executed if it is determined at step S3520 that the first paper passage detection sensor 162 is turned on, of turning off the timer to stop measurement at the timing of turning on; and a step S3540, executed after step S3530, of calculating the amount of deviation from the conveyance time of paper measured by the timer, and ending the routine.

The flow of measuring the amount of deviation when the sheets of paper are fed from the fourth paper feed tray 62D is the same as above.

[Operation]

Referring to FIG. 15, the operation of image forming apparatus in accordance with the present embodiment, based on the above-described structure and the flowchart, will be described in the following.

When start key 192 to start copying is pressed, or a print instruction is received from an external device, controller 170 receives the information related to the paper size (step S1000 shown in FIG. 15). Receiving the information related to the paper size, image forming apparatus 100 selects the paper feed tray containing the paper of the received paper size, by looking-up the information related to the paper size stored in RAM 176, from multi-stage paper feed trays 62A. 62B, 62C and 62D (step S1006).

When the paper feed tray is selected, the sheets of paper in the selected paper feed tray are successively fed one by one to the paper conveying path. When the first sheet of paper is fed to the paper conveying path S (step S1010), the second sheet of paper is successively fed to the paper conveying path (step S1020). The fed first sheet of paper is conveyed by the conveying system to the registration roller pair 130. When the first sheet reaches the registration roller pair 130, the first sheet of paper abuts the nip portion of registration roller pair 130 (step S1030). The sheet abutting the registration roller pair 130 warps and hence, skew is corrected.

In the meanwhile, the amount of positional deviation at the temporary stop position is measured (step S3000). If there is any positional deviation of sheet (YES at step S3010), the timing to start re-conveyance is calculated in consideration of the amount of deviation, and re-conveyance of the succeeding sheet of paper is started at the calculated timing to start re-conveyance. Specifically, the timing to start re-conveyance is changed from the normal timing. On the other hand, if there is no positional deviation of sheet (NO at step S3010), re-conveyance of the succeeding sheet is started at the prescribed timing. Specifically, if there is no positional deviation of sheet, the timing to start re-conveyance is unchanged from the normal timing. Thus, the interval between the sheets can be kept constant at the registration roller pair 130.

[Effects of the Present Embodiment]

As is apparent from the foregoing description, use of image forming apparatus in accordance with the present embodiment attains the following effects.

Since the timing to start re-conveyance of the succeeding sheet of paper is changed in accordance with the measured amount of deviation, re-conveyance of the succeeding sheet of paper can be started at the timing of re-conveyance in accordance with the amount of deviation. Therefore, the interval between the sheets at the registration roller pair 130 can more easily be kept constant. Thus, it becomes easier to reduce variation in conveyance.

[Fourth Embodiment]

Figure 17:
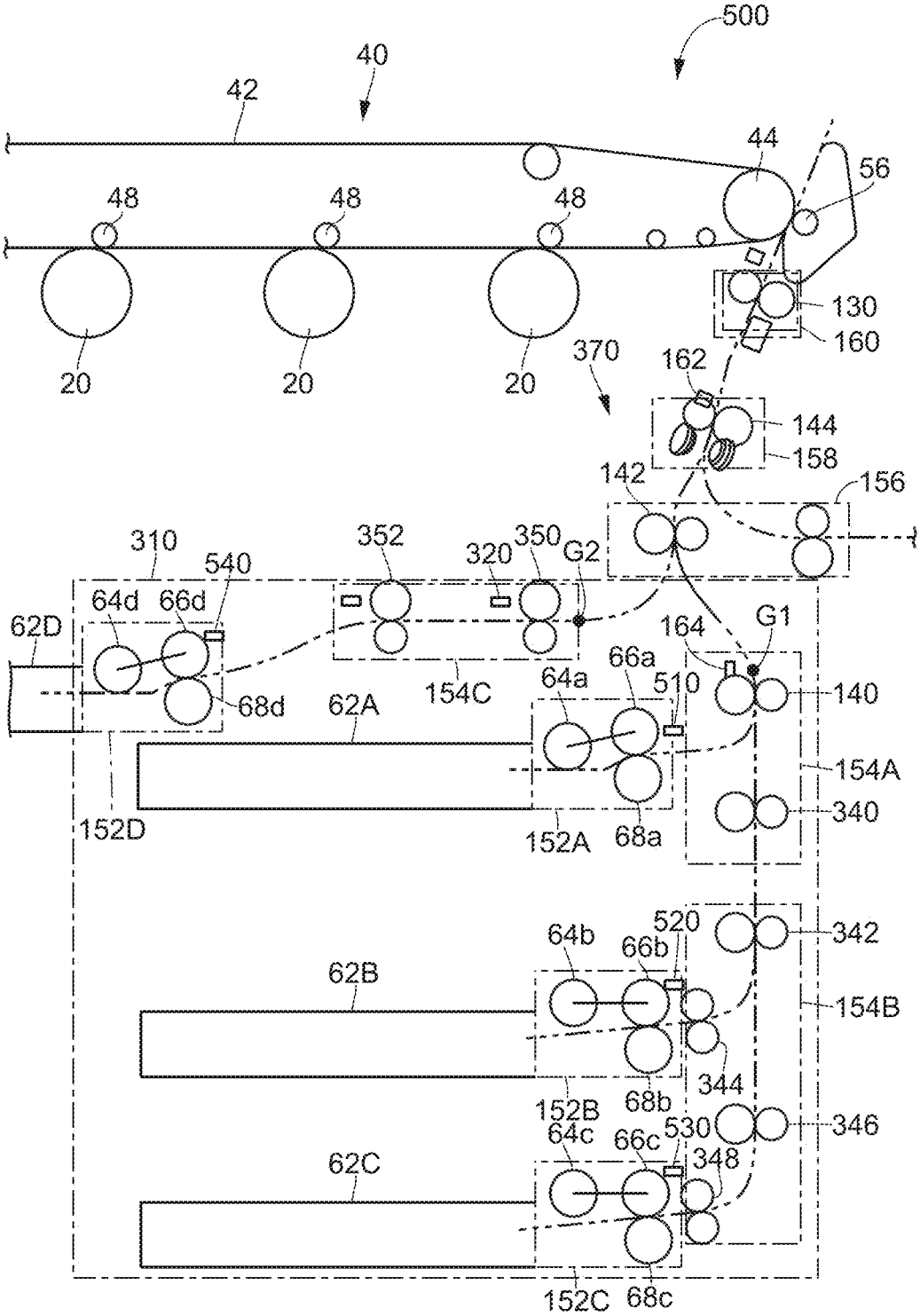
FIG. 17 schematically shows a configuration of a main portion of the paper conveying unit in the image forming apparatus in accordance with a fourth embodiment of the present invention.

Referring to FIG. 17, an image forming apparatus 500 in accordance with the present embodiment further includes, in addition to the image forming apparatus 300 in accordance with the second embodiment, paper sensors 510, 520, 530 and 540 for detecting whether a sheet is pinched between the paper feed roller and the separation roller. Specifically, paper sensors 510, 520, 530 and 540 are provided in the vicinity of each of the paper feed systems (near the nip portion between the paper feed roller and the separation roller) of multi-stage paper feed trays 62A, 62B, 62C and 62D, respectively.

Each of the paper sensors 510 to 540 detects, when the succeeding sheet of paper is temporarily stopped at the prescribed position, whether the sheet is pinched between the paper feed roller and the separation roller. If the succeeding sheet of paper is pinched at the nip portion between the paper feed roller and the separation roller, it is considered that there is hardly any positional deviation from the temporary stop position. Therefore, the succeeding sheet of paper is re-conveyed at the prescribed timing (normal timing to start re-conveyance). On the other hand, if the succeeding sheet is not pinched at the nip portion between the paper feed roller and the separation roller, it is considered that there is a positional deviation at the temporary stop position. Therefore, the timing to start re-conveyance is delayed by a prescribed time period from the normal timing to start re-conveyance. Here, the amount of deviation is substantially constant as in the first embodiment described above, and it can be detected by measurement in advance.

[Software Configuration]

Figure 18:
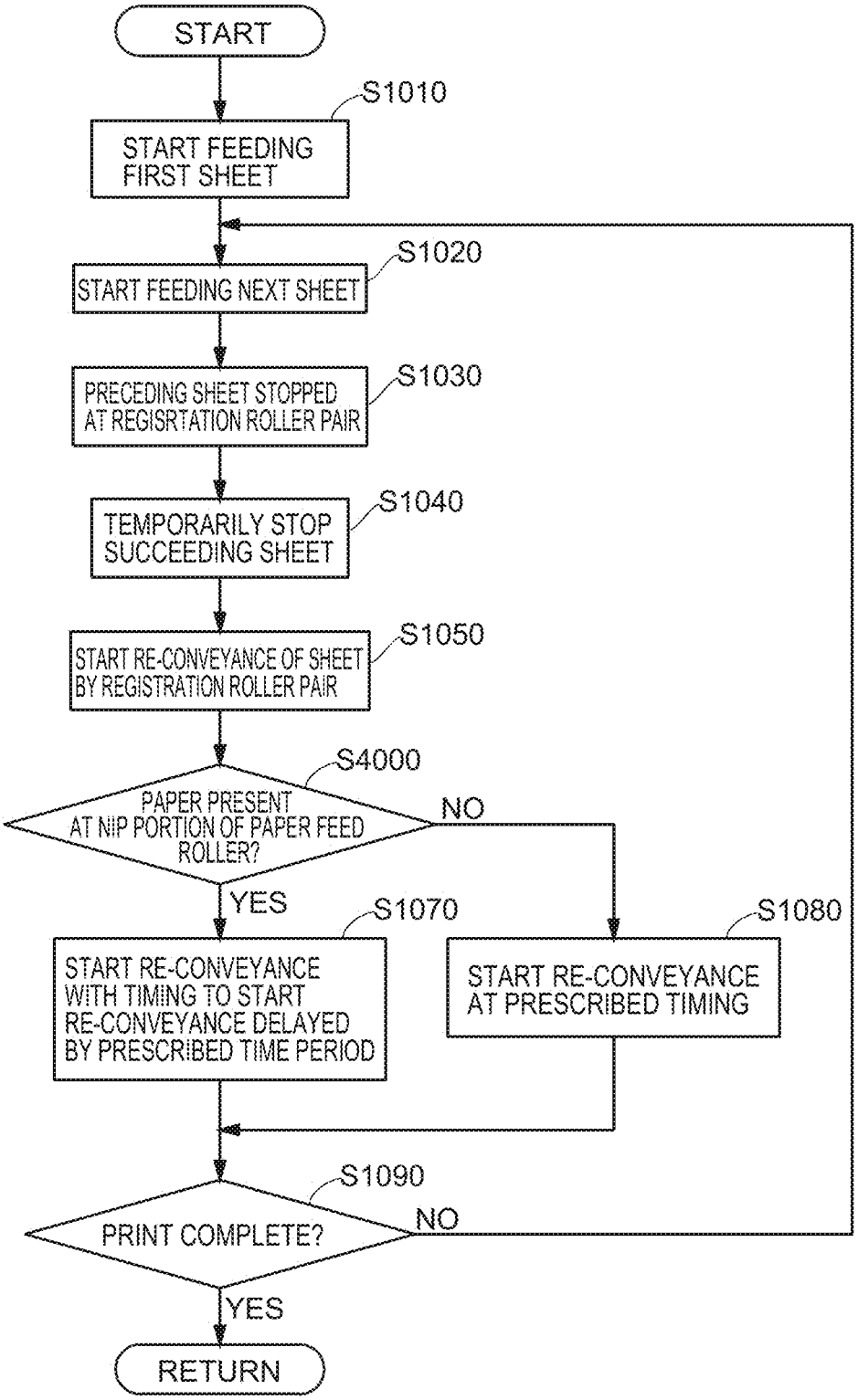
FIG. 18 is a flowchart representing a control structure of a program executed by the image forming apparatus in accordance with the fourth embodiment.

Referring to FIG. 18, in image forming apparatus 500 in accordance with the present embodiment, process steps other than step S4000 are the same as those executed by the computer program shown in FIG. 10. In the present embodiment, step S4000 mentioned above is included in place of step S1060 of FIG. 10. In the following, the difference will be described.

The program includes step S4000, executed after step S1050, of determining whether or not the sheet is pinched at the nip portion between the paper feed roller and the separation roller, and branching the flow of control depending on the result of determination. If it is determined at step S4000 that the sheet is pinched at the nip portion between the paper feed roller and the separation roller, the control proceeds to step S1070, and if it is determined that the sheet is not pinched at the nip portion between the paper feed roller and the separation roller, the control proceeds to step S1080.

[Operation]

The operation of image forming apparatus 500 in accordance with the present embodiment, based on the above-described structure and the flowchart, will be described in the following. It is noted that operations other than the operation of determining whether or not a sheet is pinched at the nip portion between the paper feed roller and the separation roller are the same as those of the first and second embodiments described above. Therefore, detailed description of similar operations will not be repeated. In the following, the operation of image forming apparatus 500 when sheets of paper are fed from the second paper feed tray 62B will be described as an example.

When the preceding sheet of paper is stopped at registration roller pair 130, the following, succeeding sheet of paper is temporarily stopped at a prescribed position. The succeeding sheet of paper is conveyed closer to the preceding sheet, and kept standby at that position. Paper sensor 520 of the second paper feed tray 62B detects whether or not the succeeding sheet of paper, which is temporarily stopped, is pinched at the nip portion between paper feed roller 66*b* and separation roller 68*b*, and transmits a detection signal to main CPU 172 of controller 170 or to sub CPU 200.

Based on the signal from paper sensor 520, controller 170 determines whether the succeeding sheet of paper is pinched at the nip portion between paper feed roller 66*b* and separation roller 68*b*, and depending on the result of determination, changes the timing to start re-conveyance of the succeeding sheet of paper.

[Effects of the Present Embodiment]

As is apparent from the foregoing description, use of image forming apparatus 500 in accordance with the present embodiment attains the following effects.

Whether or not the sheet is pinched at the nip portion between the paper feed roller and the separation roller is detected by paper sensors 510 to 540, and whether there is a positional deviation of the succeeding sheet at the temporary stop position is determined thereby. Since the timing to start re-conveyance of the succeeding sheet is changed in accordance with the result of determination, effects similar to those of the first and second embodiments can be attained.

[Modifications]

Though the present invention is applied to an MFP as an example of image forming apparatuses in the embodiments above, the present invention is not limited to such embodiments. For example, the image forming apparatus may be a copy machine or a printer.

Though an example in which the paper conveying unit includes a sub CPU has been described in the embodiments above, the present invention is not limited to such embodiments. For example, a configuration in which the paper conveying unit is not provided with the sub CPU is also possible. Specifically, paper conveying unit may be controlled only by the main CPU. If the paper conveying unit includes a sub CPU, part of the paper conveying unit may be controlled by the main CPU. Further, the registration roller motor may be connected not to the sub CPU but to the main CPU.

In the embodiment above, the paper feed tray may be a mixed-loading type paper feed tray. When multi-stage paper feed trays are used, all or some of the paper feed trays may be of the mixed-loading type.

Though an example in which the paper size is unchanged during printing has been described in the embodiments above, the present invention is not limited to such embodiments. For example, printing may be done with the paper size changed during printing. In that case, the information related to the paper size (paper length in the conveying direction) and the path length (the distance from the nip portion between the paper feed roller and the separation roller to the temporary stop position) may be received at the timing when the paper size is changed.

Though an example in which the paper size of sheets of paper stacked and contained in the paper feed tray is detected, for example, by a sensor unit provided in the paper feed tray has been described in the embodiments above, the present invention is not limited to such embodiments. The paper size of paper to be conveyed may be detected by any method other than the one described in the embodiments above. Further, in the embodiments above, the sensor unit need not be provided in the paper feed tray. By way of example, it the paper size of contained sheets of paper is determined tray by tray and the paper size is set in advance, the paper size of sheets stacked and contained may be detected without providing any sensor unit. Further, the paper size of sheets of paper stacked and contained in each paper feed tray may be set by operation unit 190 (display panel 194). In other words, the paper size of sheets of paper stacked and contained in paper feed tray may be input by the user. In that case, the paper size input through operation unit 190 is stored in a memory such as an RAM, in association with the paper feed tray.

Though an example in which the information related to the paper size is stored in the RAM has been described in the embodiments above, the present invention is not limited to such embodiments. The memory storing the information related to the paper size may be any memory other than the RAM.

Though an example in which the paper conveyance program is transmitted from another device to the controller through the LAN line and the NIC and stored in the ROM or HDD has been described in the embodiments above, the present invention is not limited to such embodiments. By way of example, a disk drive such as a DVD drive. CD-ROM drive or FD drive, a memory port or the like may be provided in place of NIC, and the paper conveyance program recorded on an external storage medium may be introduced to the image forming apparatus therethrough.

In the second to fourth embodiments above, an example in which any sheet of paper fed from the first, second and third paper feed trays is stopped at a timing when the leading edge of the sheet is detected by the second paper passage detection sensor has been described. The present invention, however, is not limited to such embodiments. By way of example, any sheet of paper fed from a plurality of paper feed trays to the paper conveying path may be stopped a prescribed time period after the leading edge of the sheet is detected by the paper passage detection sensor.

In the second to fourth embodiments above, an example in which for any sheet of paper fed from the first, second and third paper feed trays, the temporary stop position is the same has been described. The present invention, however, is not limited to such embodiments. By way of example, for the sheet of paper fed from a plurality of paper feed trays to the paper conveying path, the temporary stop position may be made different. It is noted, however, that by temporarily stopping at the same position, the effects of the embodiments above can be attained. Therefore, the temporary stopping position should preferably be the same for any of the sheets fed from the plurality of paper feed trays to the paper conveying path.

In the third and fourth embodiments above, an example of an image forming apparatus having multi-stage paper feed trays has been described. The present invention, however, is not limited to such embodiments. The image forming apparatus of the third and fourth embodiments may be an image forming apparatus having one stage of paper feed tray as in the first embodiment.

In the embodiments above, the number of stages of the paper feed tray can appropriately be changed. Further, in the embodiments above, the image forming apparatus may be provided with an automatic paper feed cassette capable of containing a large amount of paper of different types.

Any embodiment that can be attained by appropriately combining the techniques described above is encompassed by the scope of the present invention. By way of example, the second and third embodiments may be combined. In such a combination, even if the amount of deviation detected in advance by measurement (amount of deviation at the temporary stop position of the succeeding sheet) should be changed, the succeeding sheet can be re-conveyed at timing in accordance with the changed amount of deviation.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

INDUSTRIAL APPLICABILITY

By the present invention, a paper conveying device capable of conveying sheets of paper without lowering print quality and increasing the number of prints per unit time, an image forming apparatus provided with the device, and a method of conveying sheets of paper can be provided.

REFERENCE SIGNS LIST

20 photoreceptor drum
22 charger
30 image forming unit
62, 62A~62D paper feed tray
70, 370 paper conveying unit
92 scanner unit
100, 300, 500 image forming apparatus
130 registration roller pair
140, 142, 144 conveyer roller
162 first paper passage detection sensor
164 second paper passage detection sensor
170 controller
190 operation unit
192 start key
194 display panel
320 third paper passage detection sensor

The invention claimed is:

1. A paper conveying device, comprising:

a paper feeding section for feeding a sheet of paper to a paper conveying path;

a registration section, provided along said paper conveying path, for temporarily stopping the conveyed sheet of paper and re-conveying the sheet of paper;

a conveying section, provided in said paper conveying path from said paper feeding section to said registration section, for conveying the sheet of paper fed to said paper conveying path to said registration section;

a controller configured to:

receive information related to a size of the conveyed sheet of paper;

control conveyance of the sheet of paper such that when a plurality of sheets of paper are fed successively to said paper conveying path and a preceding sheet of paper is stopped at said registration section, a following, succeeding sheet of paper is temporarily stopped at a prescribed position downstream of said conveying section in the paper conveying direction, and then the sheet is re-conveyed toward said registration section at a prescribed timing;

change a timing to start re-conveyance of the succeeding sheet of paper in accordance with paper length in the paper conveying direction of the conveyed sheet of paper received by said controller; and change the timing to start re-conveyance of the succeeding sheet of paper based on a path length from said paper feeding section to the position at which the succeeding sheet of paper is temporarily stopped and on said paper length of the conveyed sheet of paper.

2. The paper conveying device according to claim 1, further comprising:

a paper detection section, arranged close to said conveying section, at a prescribed position upstream of said registration section in the paper conveying direction, for detecting a state of conveyance of the sheet of paper;

wherein the controller is further configured to temporarily stop the succeeding sheet of paper at the prescribed position downstream of said conveying section in the paper conveying direction, at a timing when said controller detects a leading edge of the sheet.

3. The paper conveying device according to claim 1, further comprising:

a paper detection section, arranged close to said conveying section, at a prescribed position upstream of said registration section in the paper conveying direction, for detecting a state of conveyance of the sheet of paper; wherein the controller is further configured to temporarily stop the succeeding sheet of paper at the prescribed position downstream of said conveying section in the paper conveying direction, a prescribed time period after said controller detects a leading edge of the sheet.

4. The paper conveying device according to claim 1, further comprising:

a paper detection section, arranged close to said conveying section, at a prescribed position upstream of said registration section in the paper conveying direction, for detecting a state of conveyance of the sheet of paper; and a plurality of paper containing sections for containing sheets of paper to be fed to said paper conveying path; wherein wherein said controller is further configured to temporarily stop any sheet of paper fed from said plurality of paper containing section to said paper conveying path, at the prescribed position downstream of said conveying section in the paper conveying direction, at a timing when said controller detects a leading edge of the sheet.

5. The paper conveying device according to claim 1, further comprising:

a paper detection section, arranged close to said conveying section, at a prescribed position upstream of said registration section in the paper conveying direction, for detecting a state of conveyance of the sheet of paper; and a plurality of paper containing sections for containing sheets of paper to be fed to said paper conveying path; wherein the controller is further configured to temporarily stop any sheet of paper fed from said plurality of paper containing section to said paper conveying path, at the prescribed position downstream of said conveying section in the paper conveying direction, a prescribed time period after said controller detects a leading edge of the sheet.

6. An image forming apparatus, comprising:

an image forming section for forming an image; and the paper conveying device according to claim 1, for conveying sheets of paper to said image forming section.

7. A paper conveying device, comprising:

a paper feeding section for feeding a sheet of paper to a paper conveying path;

a registration section, provided along said paper conveying path, for temporarily stopping the conveyed sheet of paper and re-conveying the sheet of paper;

a conveying section, provided in said paper conveying path from said paper feeding section to said registration section, for conveying the sheet of paper fed to said paper conveying path to said registration section;

a controller configured to receive information related to a size of the conveyed sheet of paper; and control conveyance of the sheet of paper such that when a plurality of sheets of paper are fed successively to said paper conveying path and a preceding sheet of paper is stopped at said registration section, a following, succeeding sheet of paper is temporarily stopped at a prescribed position downstream of said conveying section in the paper conveying direction, and then the sheet is re-conveyed toward said registration section at a prescribed timing; wherein change a timing to start re-conveyance of the succeeding sheet of paper in accordance with paper length in the paper conveying direction of the conveyed sheet of paper received by said controller; and determine whether said paper length of the conveyed sheet of paper is shorter than a path length from said paper feeding section to the position at which the succeeding sheet of paper is temporarily stopped, and change the timing to start re-conveyance of the succeeding sheet of paper depending on the result of determination.

8. The paper conveying device according to claim 7, wherein when said paper length of the conveyed sheet of paper is determined to be shorter than the path length from said paper feeding section to the position at which the succeeding sheet of paper is temporarily stopped, said controller is further configured to change the timing delays said timing to start re-conveyance of the succeeding sheet of paper by a prescribed time period; and when said paper length of the conveyed sheet of paper is determined to be not shorter than the path length from said paper feeding section to the position at which the succeeding sheet of paper is temporarily stopped, said controller is further configured to change the timing does not change said timing to start re-conveyance of the succeeding sheet of paper.

9. The paper conveying device according to claim 7, further comprising:

a paper detection section, arranged close to said conveying section, at a prescribed position upstream of said registration section in the paper conveying direction, for detecting a state of conveyance of the sheet of paper; wherein wherein the controller is further configured to temporarily stop the succeeding sheet of paper at the prescribed position downstream of said conveying section in the paper conveying direction, at a timing when said controller detects a leading edge of the sheet.

10. The paper conveying device according to claim 7, further comprising:

a paper detection section, arranged close to said conveying section, at a prescribed position upstream of said registration section in the paper conveying direction, for detecting a state of conveyance of the sheet of paper; wherein said controller is further configured to temporarily stop the succeeding sheet of paper at the prescribed position downstream of said conveying section in the paper conveying direction, a prescribed time period after said controller detects a leading edge of the sheet.

11. The paper conveying device according to claim 7, further comprising:

a paper detection section, arranged close to said conveying section, at a prescribed position upstream of said registration section in the paper conveying direction, for detecting a state of conveyance of the sheet of paper; and a plurality of paper containing sections for containing sheets of paper to be fed to said paper conveying path;

wherein said controller is configured to temporarily stop any sheet of paper fed from said plurality of paper containing section to said paper conveying path, at the prescribed position downstream of said conveying section in the paper conveying direction, at a timing when said detects a leading edge of the sheet.

12. The paper conveying device according to claim 7, further comprising:

a paper detection section, arranged close to said conveying section, at a prescribed position upstream of said registration section in the paper conveying direction, for detecting a state of conveyance of the sheet of paper; and a plurality of paper containing sections for containing sheets of paper to be fed to said paper conveying path;

wherein the controller is further configured to temporarily stop any sheet of paper fed from said plurality of paper containing section to said paper conveying path, at the prescribed position downstream of said conveying section in the paper conveying direction, a prescribed time period after said controller detects a leading edge of the sheet.

13. An image forming apparatus, comprising:

an image forming section for forming an image; and the paper conveying device according to claim 7, for conveying sheets of paper to said image forming section.

14. A paper conveying device, comprising:

a paper feeding section for feeding a sheet of paper to a paper conveying path;

a registration section, provided along said paper conveying path, for temporarily stopping the conveyed sheet of paper and re-conveying the sheet of paper;

a conveying section, provided in said paper conveying path from said paper feeding section to said registration section, for conveying the sheet of paper fed to said paper conveying path to said registration section;

a controller configured to receive information related to a size of the conveyed sheet of paper;

control conveyance of the sheet of paper such that when a plurality of sheets of paper are fed successively to said paper conveying path and a preceding sheet of paper is stopped at said registration section, a following, succeeding sheet of paper is temporarily stopped at a prescribed position downstream of said conveying section in the paper conveying direction, and then the sheet is re-conveyed toward said registration section at a prescribed timing;

measure amount of positional deviation generated when the succeeding sheet of paper is temporarily stopped at the prescribed position downstream of said conveying section in the paper conveying direction;

change a timing to start re-conveyance of the succeeding sheet of paper in accordance with paper length in the paper conveying direction of the conveyed sheet of paper received by said controller; and change the timing to start re-conveyance of the succeeding sheet of paper in accordance with the amount of positional deviation measured by said controller.

15. The paper conveying device according to claim 14, further comprising:

a paper detection section, arranged close to said conveying section, at a prescribed position upstream of said registration section in the paper conveying direction, for detecting a state of conveyance of the sheet of paper; wherein the controller is further configured to temporarily stop the succeeding sheet of paper at the prescribed position downstream of said conveying section in the paper conveying direction, at a timing when said controller detects a leading edge of the sheet.

16. The paper conveying device according to claim 14, further comprising:

a paper detection section, arranged close to said conveying section, at a prescribed position upstream of said registration section in the paper conveying direction, for detecting a state of conveyance of the sheet of paper; wherein said controller is further configured to temporarily stop the succeeding sheet of paper at the prescribed position downstream of said conveying section in the paper conveying direction, a prescribed time period after said controller detects a leading edge of the sheet.

17. The paper conveying device according to claim 14, further comprising:

a paper detection section, arranged close to said conveying section, at a prescribed position upstream of said registration section in the paper conveying direction, for detecting a state of conveyance of the sheet of paper; and a plurality of paper containing sections for containing sheets of paper to be fed to said paper conveying path; wherein said controller is further configured to temporarily stop any sheet of paper fed from said plurality of paper containing section to said paper conveying path, at the prescribed position downstream of said conveying section in the paper conveying direction, at a timing when said controller detects a leading edge of the sheet.

18. The paper conveying device according to claim 14, further comprising:

a paper detection section, arranged close to said conveying section, at a prescribed position upstream of said registration section in the paper conveying direction, for detecting a state of conveyance of the sheet of paper; and a plurality of paper containing sections for containing sheets of paper to be fed to said paper conveying path; wherein said controller is further configured to temporarily stop any sheet of paper fed from said plurality of paper containing section to said paper conveying path, at the prescribed position downstream of said conveying section in the paper conveying direction, a prescribed time period after said controller detects a leading edge of the sheet.

19. An image forming apparatus, comprising:

an image forming section for forming an image; and the paper conveying device according to claim 14, for conveying sheets of paper to said image forming section.

* * * * *